US008793953B2

(12) United States Patent
Richardson et al.

(10) Patent No.: US 8,793,953 B2
(45) Date of Patent: Aug. 5, 2014

(54) CLIP-ON CONNECTION SYSTEM FOR STAY-IN-PLACE FORM-WORK

(75) Inventors: George David Richardson, Vancouver, CA (US); Semion Krivulin, Richmond, CA (US)

(73) Assignee: CFS Concrete Forming Systems Inc., Vancouver (CA)

( * ) Notice: Subject to any disclaimer, the term of this patent is extended or adjusted under 35 U.S.C. 154(b) by 106 days.

(21) Appl. No.: 13/202,216

(22) PCT Filed: Feb. 17, 2010

(86) PCT No.: PCT/CA2010/000197

§ 371 (c)(1), (2), (4) Date: Sep. 27, 2011

(87) PCT Pub. No.: WO2010/094111

PCT Pub. Date: Aug. 26, 2010

(65) Prior Publication Data

US 2012/0056344 A1 Mar. 8, 2012

Related U.S. Application Data

(60) Provisional application No. 61/153,488, filed on Feb. 18, 2009.

(51) Int. Cl.
*E04B 2/00* (2006.01)
*E04B 2/86* (2006.01)

(52) U.S. Cl.
CPC ..... *E04B 2/8641* (2013.01); *E04B 2/8652* (2013.01)
USPC ..... 52/429; 52/422; 52/439

(58) Field of Classification Search
CPC ..... E04B 2/8641; E04B 2/8652; E04B 2002/867; E04B 2002/8676
USPC ..... 52/415, 422, 424, 425, 426, 428, 429, 52/434, 435, 439, 588.1, 563
See application file for complete search history.

(56) References Cited

U.S. PATENT DOCUMENTS 154,179 A 8/1874 Hubert
374,826 A 12/1887 Clarke (Continued)

FOREIGN PATENT DOCUMENTS

CA 0574720 4/1959
CA 0957816 11/1974

(Continued)

OTHER PUBLICATIONS

Vector Corrosion Technologies Marketing Materials, 2005.

(Continued)

*Primary Examiner* — Joshua J Michener
*Assistant Examiner* — James Ference
(74) *Attorney, Agent, or Firm* — Oyen Wiggs Green & Mutala LLP

(57) ABSTRACT

A stay-in-place form-work for casting a concrete structure comprises a plurality of elongate panels interconnectable in edge-to-edge relationship via complementary connector components on their longitudinal edges to define at least a portion of a perimeter of the form-work. The panels include a first panel having a first connector component incorporating a receptacle, and a second panel having a second connector component incorporating a protrusion. The first and second panels are connectable to one another in edge-to-edge relationship by: effecting a loose-fit connection by extending the protrusion of the second connector component into the receptacle of the first connector component; loosely seating a clip onto the first and second connector components; and pushing the clip against the first and second connector components to reach a locked configuration wherein restorative deformation forces associated with the clip act to retain the first and second connector components in the locked configuration.

30 Claims, 23 Drawing Sheets

(56) References Cited

U.S. PATENT DOCUMENTS

| | | | | |
|---|---|---|---|---|
| 510,720 | A | 12/1893 | Stewart, Jr. | |
| 820,246 | A | 5/1906 | Nidds | |
| 1,035,206 | A | 8/1912 | Lewen | |
| 1,080,221 | A | 12/1913 | Jester | |
| 1,244,608 | A | 10/1917 | Hicks | |
| 1,276,147 | A | 8/1918 | White | |
| 1,345,156 | A | 6/1920 | Flynn | |
| 1,423,879 | A | 7/1922 | Potter | |
| 1,637,410 | A | 8/1927 | Corybell | |
| 1,653,197 | A | 12/1927 | Barnes | |
| 1,715,466 | A | 6/1929 | Miller | |
| 1,820,897 | A | 8/1931 | White et al. | |
| 1,875,242 | A | 8/1932 | Hathaway | |
| 1,915,611 | A | 6/1933 | Miller | |
| 2,008,162 | A | 7/1935 | Waddell | |
| 2,050,258 | A | 8/1936 | Bemis | |
| 2,076,472 | A | 4/1937 | London | |
| 2,164,681 | A * | 7/1939 | Fould | 52/568 |
| 2,172,052 | A | 9/1939 | Robbins | |
| 2,326,361 | A | 8/1943 | Jacobsen | |
| 2,406,581 | A * | 8/1946 | Bergstrom et al. | 423/195 |
| 2,861,277 | A | 11/1958 | Hermann | |
| 2,892,340 | A | 6/1959 | Fort | |
| 3,063,122 | A | 11/1962 | Katz | |
| 3,100,677 | A | 8/1963 | Frank et al. | |
| 3,152,354 | A | 10/1964 | Diack | |
| 3,184,013 | A * | 5/1965 | Pavlecka | 52/275 |
| 3,196,990 | A | 7/1965 | Handley | |
| 3,220,151 | A | 11/1965 | Goldman | |
| 3,288,427 | A | 11/1966 | Pluckebaum | |
| 3,291,437 | A | 12/1966 | Bowden et al. | |
| 3,468,088 | A | 9/1969 | Miller | |
| 3,555,751 | A | 1/1971 | Thorgusen | |
| 3,588,027 | A | 6/1971 | Bowden | |
| 3,788,020 | A | 1/1974 | Gregori | |
| 3,886,705 | A | 6/1975 | Cornland | |
| 3,951,294 | A | 4/1976 | Wilson | |
| 3,991,636 | A | 11/1976 | Devillers | |
| 4,023,374 | A | 5/1977 | Colbert et al. | |
| 4,060,945 | A | 12/1977 | Wilson | |
| 4,104,837 | A | 8/1978 | Naito | |
| 4,106,233 | A | 8/1978 | Horowitz | |
| 4,180,956 | A | 1/1980 | Gross | |
| 4,276,730 | A | 7/1981 | Lewis | |
| 4,351,870 | A | 9/1982 | English | |
| 4,383,674 | A | 5/1983 | Fricker | |
| 4,433,522 | A | 2/1984 | Yerushalmi | |
| 4,434,597 | A | 3/1984 | Fischer | |
| 4,508,310 | A | 4/1985 | Schultz | |
| 4,532,745 | A | 8/1985 | Kinard | |
| 4,543,764 | A | 10/1985 | Kozikowski | |
| 4,550,539 | A | 11/1985 | Foster | |
| 4,553,875 | A | 11/1985 | Casey | |
| 4,575,985 | A | 3/1986 | Eckenrodt | |
| 4,581,864 | A | 4/1986 | Shvakhman et al. | |
| 4,606,167 | A | 8/1986 | Thorne | |
| 4,695,033 | A | 9/1987 | Imaeda et al. | |
| 4,703,602 | A | 11/1987 | Pardo | |
| 4,731,964 | A | 3/1988 | Phillips | |
| 4,731,971 | A | 3/1988 | Terkl | |
| 4,742,665 | A | 5/1988 | Baierl | |
| 4,856,754 | A | 8/1989 | Yokota et al. | |
| 4,866,891 | A | 9/1989 | Young | |
| 4,946,056 | A | 8/1990 | Stannard | |
| 4,995,191 | A | 2/1991 | Davis | |
| 5,014,480 | A | 5/1991 | Guarriello et al. | |
| 5,028,368 | A | 7/1991 | Grau | |
| 5,124,102 | A | 6/1992 | Serafini | |
| 5,216,863 | A | 6/1993 | Nessa et al. | |
| 5,243,805 | A | 9/1993 | Fricker | |
| 5,265,750 | A | 11/1993 | Whiteley | |
| 5,311,718 | A | 5/1994 | Trousilek | |
| 5,465,545 | A | 11/1995 | Trousilek | |
| 5,489,468 | A | 2/1996 | Davidson | |
| 5,491,947 | A | 2/1996 | Kim | |
| 5,513,474 | A | 5/1996 | Scharkowski | |
| 5,516,863 | A | 5/1996 | Abusleme et al. | |
| 5,553,430 | A | 9/1996 | Majnaric et al. | |
| 5,591,265 | A | 1/1997 | Tusch | |
| 5,608,999 | A | 3/1997 | McNamara | |
| 5,625,989 | A | 5/1997 | Brubaker et al. | |
| 5,714,045 | A | 2/1998 | Lasa et al. | |
| 5,729,944 | A | 3/1998 | De Zen | |
| 5,740,648 | A | 4/1998 | Piccone | |
| 5,747,134 | A | 5/1998 | Mohammed et al. | |
| 5,791,103 | A | 8/1998 | Coolman | |
| 5,824,347 | A | 10/1998 | Serafini | |
| 5,860,262 | A | 1/1999 | Johnson | |
| 5,953,880 | A | 9/1999 | De Zen | |
| 5,987,830 | A | 11/1999 | Worley | |
| 6,161,989 | A | 12/2000 | Kotani et al. | |
| 6,167,669 | B1 | 1/2001 | Lanc | |
| 6,167,672 | B1 | 1/2001 | Okitomo | |
| 6,185,884 | B1 | 2/2001 | Myers et al. | |
| 6,189,269 | B1 | 2/2001 | De Zen | |
| 6,212,845 | B1 | 4/2001 | De Zen | |
| 6,219,984 | B1 | 4/2001 | Piccone | |
| 6,220,779 | B1 | 4/2001 | Warner et al. | |
| 6,247,280 | B1 | 6/2001 | Grinshpun et al. | |
| 6,387,309 | B1 | 5/2002 | Kojima | |
| 6,435,470 | B1 | 8/2002 | Lahham et al. | |
| 6,435,471 | B1 | 8/2002 | Piccone | |
| 6,530,185 | B1 | 3/2003 | Scott et al. | |
| 6,550,194 | B2 | 4/2003 | Jackson et al. | |
| 6,622,452 | B2 | 9/2003 | Alvaro | |
| 6,694,692 | B2 | 2/2004 | Piccone | |
| 6,832,456 | B1 | 12/2004 | Bilowol | |
| 6,866,445 | B2 | 3/2005 | Semler | |
| 6,935,081 | B2 | 8/2005 | Dunn et al. | |
| 7,320,201 | B2 | 1/2008 | Kitchen et al. | |
| 7,444,788 | B2 | 11/2008 | Morin et al. | |
| 2003/0005659 | A1 | 1/2003 | Moore, Jr. | |
| 2003/0009967 | A1 | 1/2003 | Piccone | |
| 2003/0085482 | A1 | 5/2003 | Sincock et al. | |
| 2003/0155683 | A1 | 8/2003 | Pietrobon | |
| 2004/0010994 | A1 | 1/2004 | Piccone | |
| 2004/0093817 | A1 | 5/2004 | Pujol Barcons | |
| 2005/0016083 | A1 | 1/2005 | Morin et al. | |
| 2005/0016103 | A1 | 1/2005 | Piccone | |
| 2006/0213140 | A1 | 9/2006 | Morin et al. | |
| 2007/0193169 | A1 | 8/2007 | Emblin | |
| 2009/0229214 | A1 | 9/2009 | Nelson | |
| 2010/0047608 | A1 | 2/2010 | Seccombe | |
| 2010/0050552 | A1 | 3/2010 | David | |
| 2010/0071304 | A1 | 3/2010 | Richardson et al. | |
| 2010/0251657 | A1 | 10/2010 | Richardson et al. | |
| 2011/0277410 | A1 | 11/2011 | Richardson et al. | |

FOREIGN PATENT DOCUMENTS

| | | |
|---|---|---|
| CA | 1316366 | 4/1993 |
| CA | 2097226 | 11/1994 |
| CA | 2141463 | 8/1996 |
| CA | 2070079 | 6/1997 |
| CA | 2170681 | 8/1997 |
| CA | 2218600 | 6/1998 |
| CA | 2215939 | 8/1999 |
| CA | 2226497 | 10/1999 |
| CA | 2243905 | 1/2000 |
| CA | 2255256 | 1/2000 |
| CA | 2244537 | 2/2000 |
| CA | 2418885 | 8/2003 |
| CA | 2502343 | 5/2004 |
| CA | 2502392 | 5/2004 |
| CA | 2499450 | 9/2005 |
| CA | 2577217 | 1/2006 |
| CA | 2629202 | 4/2008 |
| CA | 2681963 | 10/2008 |
| CH | 317758 | 1/1957 |
| CN | 2529936 | 1/2003 |
| DE | 1684357 | 4/1967 |
| DE | 1812590 | 6/1970 |
| DE | 2062723 | 8/1972 |
| DE | 3003446 | 8/1981 |

(56) References Cited

FOREIGN PATENT DOCUMENTS

| | | |
|---|---|---|
| DE | 3234489 | 3/1984 |
| DE | 3727956 | 5/1988 |
| DE | 29803155 | 6/1998 |
| EP | 0025420 | 3/1981 |
| EP | 0055504 | 7/1982 |
| EP | 0141782 | 5/1985 |
| EP | 0757137 | 2/1997 |
| FR | 0507787 | 7/1920 |
| FR | 1381945 | 11/1964 |
| FR | 1603005 | 4/1971 |
| FR | 2535417 | 5/1984 |
| FR | 2721054 | 6/1994 |
| FR | 2717848 | 9/1995 |
| GB | 779916 | 7/1957 |
| GB | 2141661 | 1/1985 |
| GB | 2205624 | 12/1988 |
| JP | 05133028 | 5/1993 |
| JP | 09041612 | 2/1997 |
| JP | 2008223335 | 9/2008 |
| SE | 206538 | 8/1966 |
| WO | 8204088 | 11/1982 |
| WO | 9500724 | 1/1995 |
| WO | 9607799 | 3/1996 |
| WO | 9635845 | 11/1996 |
| WO | 9743496 | 11/1997 |
| WO | 0163066 | 8/2001 |
| WO | 0173240 | 10/2001 |
| WO | 03006760 | 1/2003 |
| WO | 2004088064 | 10/2004 |
| WO | 2008119178 | 10/2008 |
| WO | 2009092158 | 7/2009 |
| WO | 2010037211 | 4/2010 |

OTHER PUBLICATIONS

Vector Corrosion Technologies Marketing Materials, 2007.
Vector Corrosion Technologies Marketing Materials, 2008.
Digigraph Brochure, Building Systems using PVC extrusions and concrete, accessed online Jan. 2012.
Digigraph Guide, Digigraph Systems Inc., Installation Guide for the Digigraph Construction System Composed of PVC Extrusions and Concrete, accessed online Jan. 2012.
The Digigraph System, http://www.digigraph-housing.com/web/system.ht, accessed online Jan. 2012.

* cited by examiner

28

CLIP-ON CONNECTION SYSTEM FOR STAY-IN-PLACE FORM-WORK

RELATED APPLICATION

This application claims the benefit of the priority of U.S. application No. 61/153,488 filed 18 Feb. 2009 which is hereby incorporated herein by reference.

TECHNICAL FIELD

The technology disclosed herein relates to form-work systems for fabricating structures from concrete or other curable construction materials. Particular embodiments provide connector components for modular stay-in-place forms and methods for providing connections between modular form units.

BACKGROUND

It is known to fabricate structural parts for building walls from concrete using modular stay-in-place forms. Examples of such modular stay in place forms include those described in US patent publication No. 2005/0016103 (Piccone) and PCT publication No. WO96/07799 (Sterling). A representative drawing depicting a partial form 28 according to one prior art system is shown in top plan view in FIG. 1. Form 28 includes a plurality of wall panels 30 (e.g. 30A, 30B, 30C, 30D), each of which has an inwardly facing surface 31A and an outwardly facing surface 31B. Each of panels 30 includes a terminal male T-connector component 34 at one of its transverse, longitudinally-extending edges (longitudinal being the direction into and out of the FIG. 1 page) and a terminal female C-connector component 32 at its opposing longitudinal edge. Male T-connector components 34 slide longitudinally into the receptacles of female C-connector components 32 to join edge-adjacent panels 30 to form a pair of substantially parallel wall segments (generally indicated at 27, 29). Depending on the needs for particular wall segments 27, 29, different panels 30 may have different transverse dimensions. For example, comparing panels 30A and 30B, it can be seen that panel 30A has approximately ¼ of the transverse length of panel 30B.

Form 28 includes support panels 36 which extend between, and connect to each of, wall segments 27, 29 at transversely spaced apart locations. Support panels 36 include male T-connector components 42 slidably received in the receptacles of female C-connector components 38 which extend inwardly from inwardly facing surfaces 31A or from female C-connector components 32. Form 28 comprises tensioning panels 40 which extend between panels 30 and support panels 36 at various locations within form 28. Tensioning panels 40 include male T-connector components 46 received in the receptacles of female C-connector components 38.

In use, form 28 is assembled by slidable connection of the various male T-connector components 34, 42, 46 in the receptacles of the various female C-connectors 32, 38. Liquid concrete is then introduced into form 28 between wall segments 27, 29. The concrete flows through apertures (not shown) in support panels 36 and tensioning panels 40 to fill the interior of form 28 (i.e. between wall segments 27, 29). When the concrete solidifies, the concrete (together with form 28) provide a structural component (e.g. a wall) for a building or other structure.

A problem with prior art systems is referred to colloquially as "unzipping". Unzipping refers to the separation of connector components from one another due to the weight and/or outward pressure generated by liquid concrete when it is introduced into form 28. By way of example, unzipping may occur at connector components 32, 34 between panels 30. FIG. 2 schematically depicts the unzipping of a prior art connection 50 between male T-connector component 34 and corresponding female C-connector component 32 at the edges of a pair of edge-adjacent panels 30. The concrete (not explicitly shown) on the inside 51 of connection 50 exerts outward forces on panels 50 (as shown at arrows 52, 54). These outward forces tend to cause deformation of the connector components 32, 34. In the FIG. 2 example, connector components 32, 34 may exhibit deformation in the region of reference numerals 56, 58, 60, 62, 64, 68. This deformation of connector components 32, 34 may be referred to as unzipping.

Unzipping of connector components can lead to a number of problems. In addition to the unattractive appearance of unzipped connector components, unzipping can lead to separation of male connector components 34 from female connector components 32. Form 28 may be unable to hold the liquid concrete, resulting in a loss of liquid concrete and potentially require significant repair procedures. To help counteract the unzipping problem, prior art systems typically incorporate support panels 36 and tensioning panels 40, as described above. However, support panels 36 and tensioning panels 40 represent a relatively large amount of material (typically plastic) which can increase the overall cost of form 28. Furthermore, support panels 36 and tensioning panels do not completely eliminate the unzipping problem. Notwithstanding the presence of support panels 36 and tensioning panels 40, in cases where male connector components 34 do not separate completely from female connector components 32, unzipping of connector components 32, 34 may still lead to the formation of small spaces (e.g. space 70 of FIG. 2) between connector components 32, 34. Such spaces can be difficult to clean and can represent regions for the proliferation of bacteria or other contaminants and can thereby prevent or discourage the use of form 28 for particular applications, such as those associated with food and liquid storage or handling or other applications requiring sanitary conditions or the like. Such spaces can also permit the leakage of liquids and/or gasses between inside 51 and outside 53 of panels 30. Such leakage can prevent or discourage the use of form 28 for applications where form 28 is required to be impermeable to gases or liquids. Such leakage can also lead to unsanitary conditions on the inside of form 28.

There is a general desire to provide modular form components and connections therefor which overcome or at least ameliorate drawbacks with the prior art.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 3A:
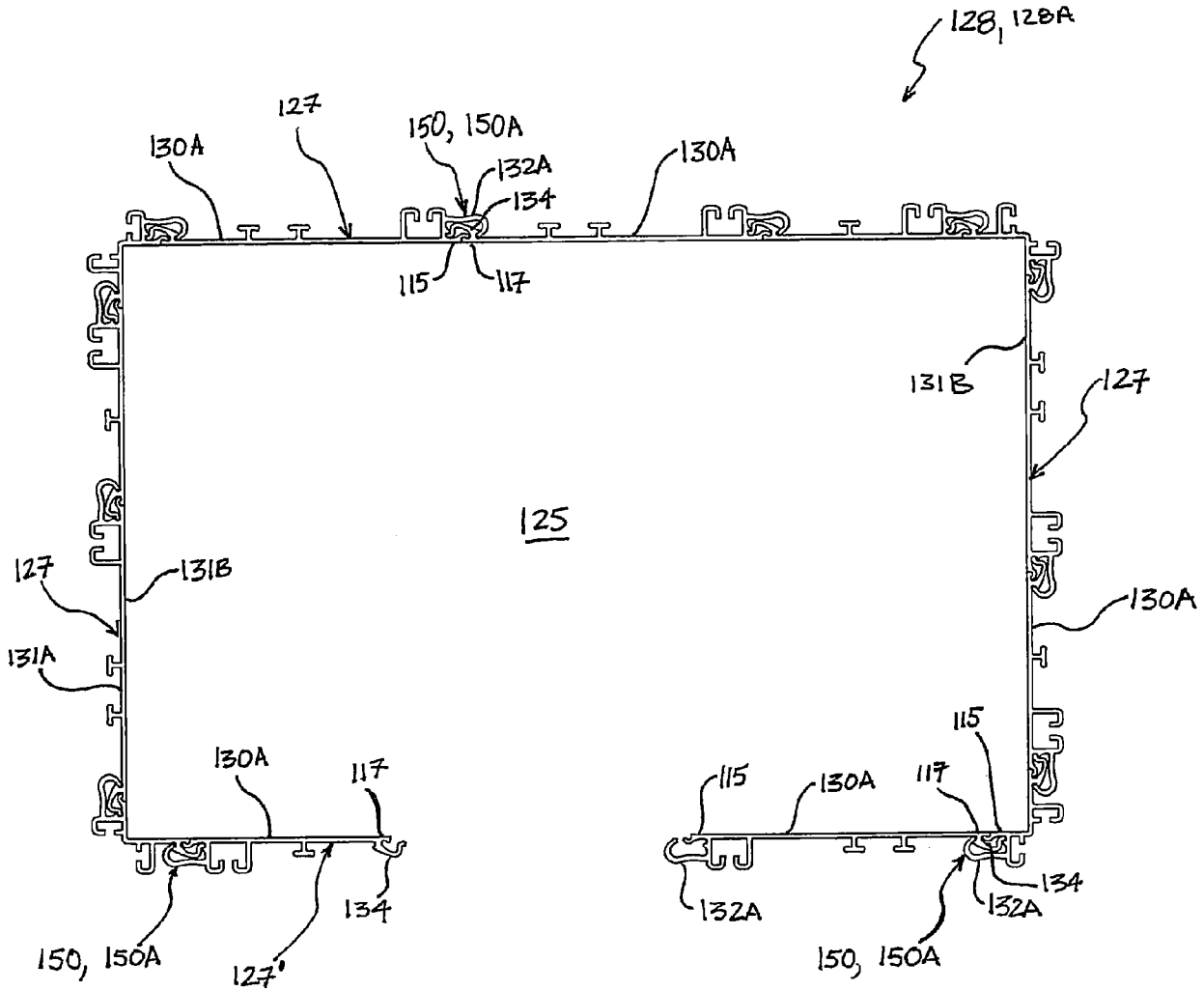
FIGS. 3A-3B (collectively, FIG. 3) are top plan views of a portion of a modular stay-in-place form according to a particular embodiment.
Figure 3B:
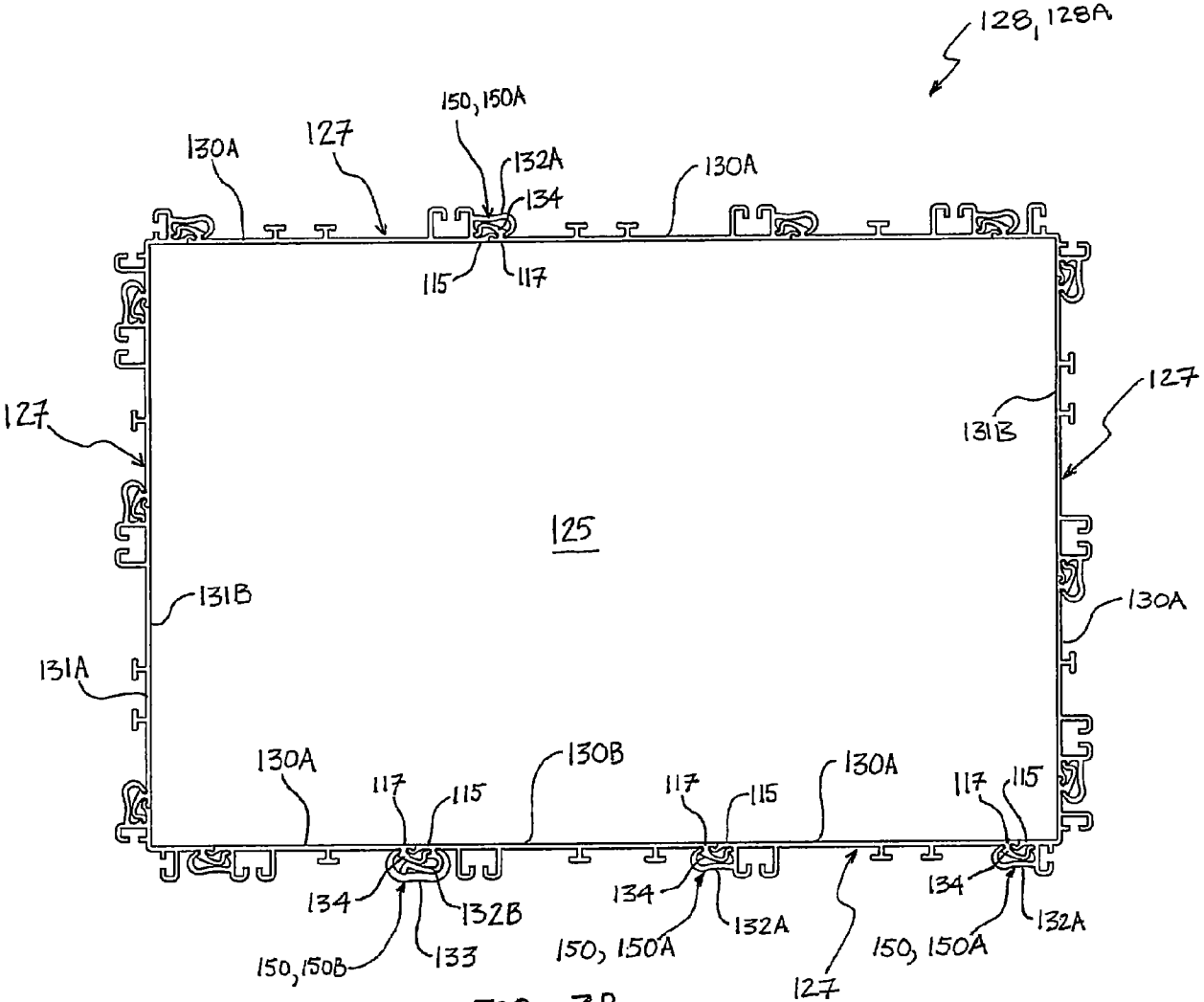

FIGS. 3A-3B are top plan views of a portion 128 of a modular stay-in-place form 128A according to a particular embodiment of the invention. Form portion 128 may be incorporated into a form 128A which may be used to fabricate a structure. Examples of forms 128A into which form portion 128 may be incorporated are described, for example, in PCT application No. PCT/CA2008/001951 filed on 7 Nov. 2008 entitled PIVOTALLY ACTIVATED CONNECTOR COMPONENTS FOR FORM-WORK SYSTEMS AND METHODS FOR USE OF SAME, which is hereby incorporated herein by reference and hereinafter referred to as the '951 PCT Application.

In the illustrated embodiment of FIG. 3, form portion 128 defines an interior surface of a structure which provides an interior space 125. By way of non-limiting example, form portion 128 may define the interior perimeter of a room or building or the interior perimeter of a hollow column or pipe. Form portion 128 includes panels 130A, 130B (generally, panels 130) which are elongated in the longitudinal direction (i.e. the direction into and out of the page of FIG. 3). Panels 130 comprise opposing surfaces 131A, 131B. In the particular example of FIG. 3, surface 131A faces toward the interior of form 128A and toward the opposing form portion (not shown) and surface 131B faces toward interior space 125.

Panels 130 may be fabricated from a lightweight and resiliently and/or elastically deformable material (e.g. a suitable plastic) using an extrusion process. By way of non-limiting example, suitable plastics include: poly-vinyl chloride (PVC), acrylonitrile butadiene styrene (ABS) or the like. In other embodiments, panels 130 may be fabricated from other suitable materials, such as steel or other suitable alloys, for example. Although extrusion is the currently preferred technique for fabricating panels 130, other suitable fabrication techniques, such as injection molding, stamping, sheet metal fabrication techniques or the like may additionally or alternatively be used. In the illustrated embodiment, panels 130 have a substantially similar cross-section along their entire longitudinal dimension, although this is not necessary. In general, panels 130 may have a number of features which differ from one another as explained in more particular detail below.

In the illustrated embodiment of FIG. 3, panels 130 are connected in edge-adjacent relationship to form wall segments 127. FIG. 3A shows panels 130A connected to form three completed wall segments 127 and one partially completed wall segment 127'. The partially completed wall segment 127' of FIG. 3A is completed to form a fourth, complete wall segment 127, as seen in FIG. 3B, by connecting a panel 130B between adjacent panels 130A on either side. In the illustrated embodiment, four wall segments 127 are arranged at right angles in the completed form portion 128 (FIG. 3B).

Panels 130 may incorporate connector components along their edges which may be joined together to form connections 150 between edge-adjacent panels 130. Form portion 128 of the FIG. 3 embodiment incorporates two different types of connections 150. A number of panels 130 are connected to one another using a first type of connection 150A. Without limiting the general applicability of connection 150A, connection 150A may be used connect adjacent panels 130 where maneuverability of panels 130 is not substantially restricted. For example, adjacent panels 130A are connected by way of connections 150A to form the partially completed form 128 shown in FIG. 3A. Connections 150A may comprise connections between first, generally female, contoured connector components 132A at edges 115 of panels 130A and second, generally male, contoured connector components 134 at edges 117 of adjacent panels 130A.

In the illustrated embodiment of FIG. 3, connections 150A and connector components 132A, 134 are similar to particular embodiments of connections and connector components described in the '951 PCT Application. To form a connection 150A between connector components 132A, 134, edge-adjacent connector components 132A, 134 may be moved relative to one another in a longitudinal direction (i.e. the direction into and out of the page of FIG. 3) such that connector components 132A, 134 slidably engage one another in an intermediate, loose-fit connection. Edge-adjacent connector components 132A, 134 (or panels 130) may then be pivoted relative to one another to thereby resiliently deform one or both of connector components 132A, 134. When one or both of connector components 132A, 134 are deformed in this manner, restorative deformation forces tend to force connector components 132A, 134 back toward their respective non-deformed states and may lock connector components 132A, 134 to one another in a "snap-together" fitting to form connection 150A.

Connections 150A are not limited to the particular connections shown in FIG. 3. In other embodiments, connector components 132A, 134 may comprise any other suitable connector components which may be connected to form connections 150A at edges 115, 117 of adjacent panels 130. For example, connections 150A and connector components 132A, 134 may be similar to other embodiments of connector components described in the '951 PCT Application, such as a generally male, curved connector component which pivots into a channel of a generally female, curved connector component. The coupling of the male and female connector components may involve resilient deformation of various features of the connector components to and corresponding use of restorative deformation forces to achieve a snap-together fitting as described above.

Connection of connector components 132A, 134 may involve pivoting and/or sliding of panels 130 or connector components 132A, 134 relative to one another, as described above. In some situations it may be difficult to pivot, slide or otherwise maneuver panels 130 relative to one another. By way of non-limiting example, these situations may include:

- completing a form portion 128 by inserting a last panel 130 into form portion 128, where all of the other panels 130 have already been positioned or assembled into form portion 128 (e.g. connecting the last panel 130B to a pair of adjacent panels 130A of the partially completed FIG. 3A form portion 128 to achieve the completed FIG. 3B form portion 128);
- connecting a panel 130 between a pair of spaced apart panels 130 that are already configured or are otherwise already in place;
- connecting corner panels 130;
- connecting panels 130 or other components of form portion 128 which are difficult to maneuver due to their size, weight or location (e.g. in corners of structures or in enclosed spaces); and/or
- the like.

For the above and other situations, a different type of connection may be provided for connecting adjacent panels 130. In the illustrated example of FIG. 3B, panel 130B (which is the last panel 130 to be connected to complete form portion 128) is connected to an adjacent panel 130A by way of connection 150A, and is connected to another adjacent panel 130A by way of a second type of connection 150B. As described below, formation of connection 150B between edge-adjacent panels 130 may reduce or eliminate pivoting and/or sliding of panels 130 as compared with other types of connections (e.g. connections 150A).

In particular embodiments, panels 130 may incorporate connector components 132B, 134 which may be initially engaged with one another and then connected to each other with a clip 133 to form connections 150B at edges 115, 117 of adjacent panels 130. Panel 130B may incorporate a first, generally female, contoured connector component 132B at edge 115. Adjacent panel 130A may incorporate a second, generally male, contoured connector component 134 at edge 117. In particular embodiments, a principal projection 158 of connector component 134 at edge 117 is pushed into a principal receptacle or recess 154 of connector component 132B at edge 115 to achieve an initial engagement between connector components 132B, 134.

Figure 5A:
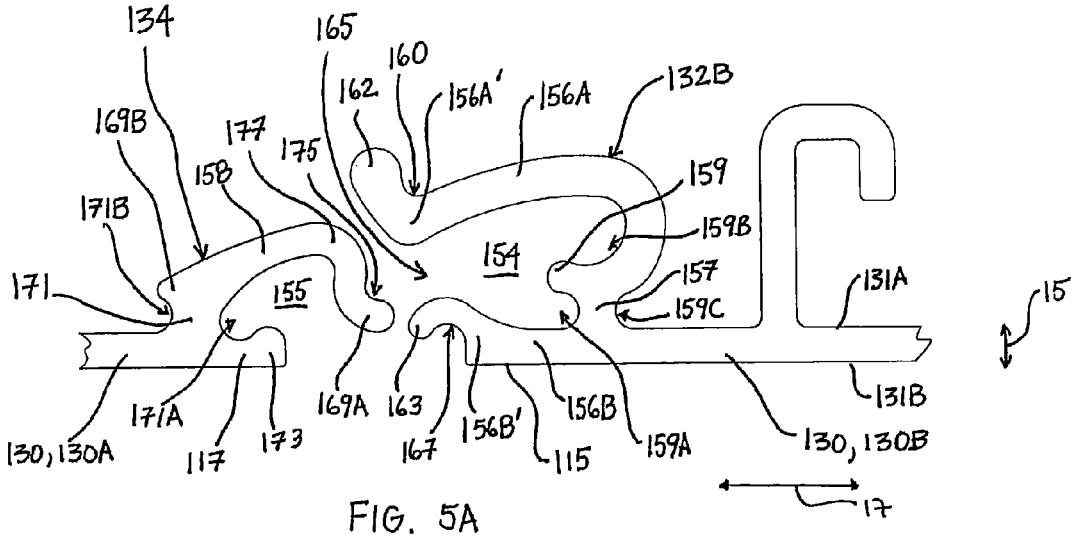
FIGS. 5A-5I (collectively, FIG. 5) represent various partial elevation views of connector components for implementing particular edge-to-edge connections between adjacent panels of the forms of FIGS. 3 and 4, and a method for coupling a clip to the connector components to form such edge-to-edge connections.
Figure 5B:
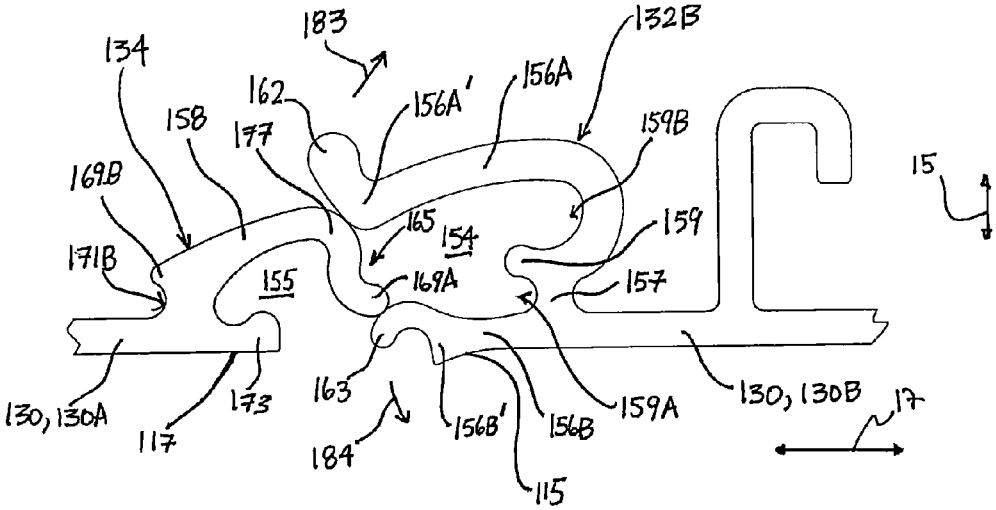
Figure 5C:
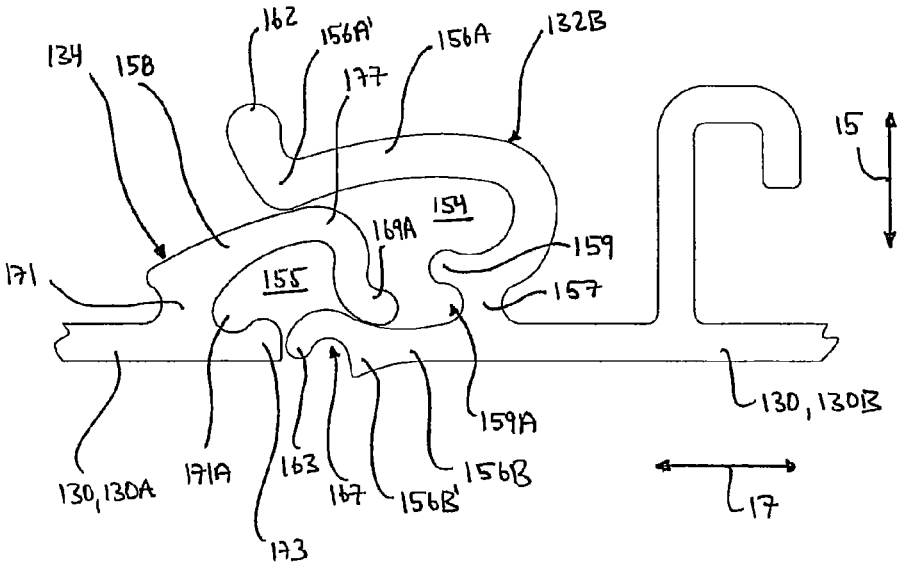
Figure 5D:
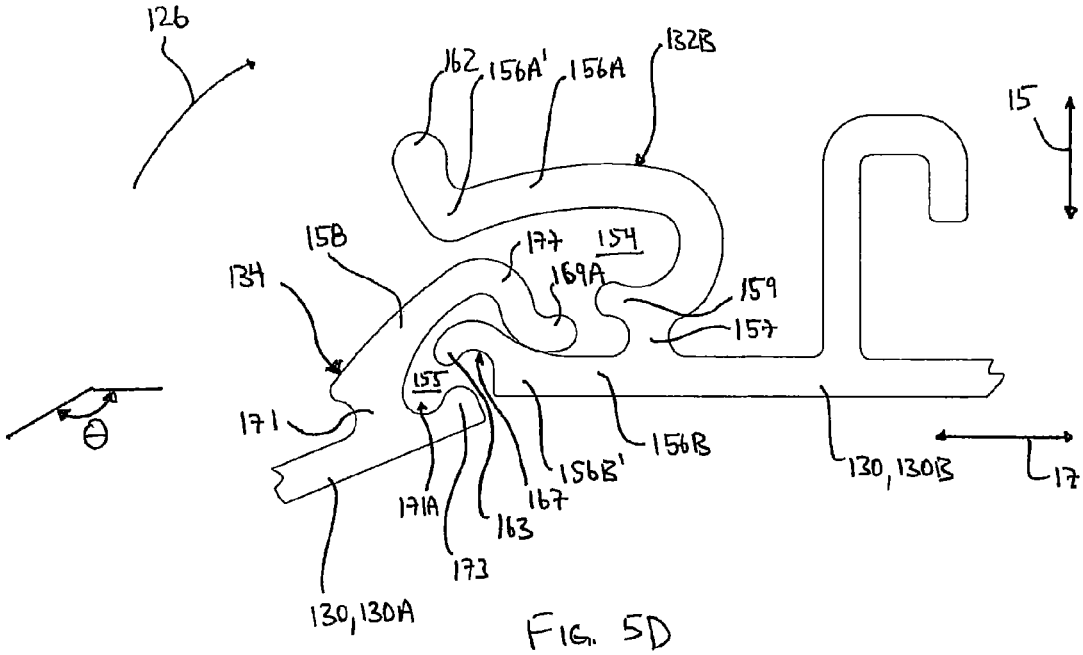
Figure 5E:
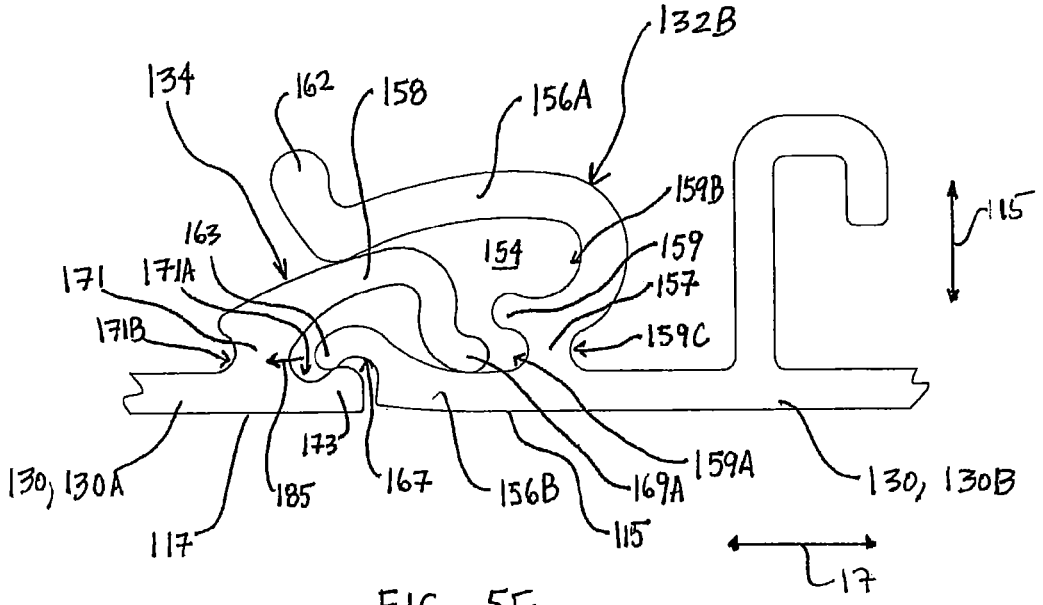
Figure 5F:
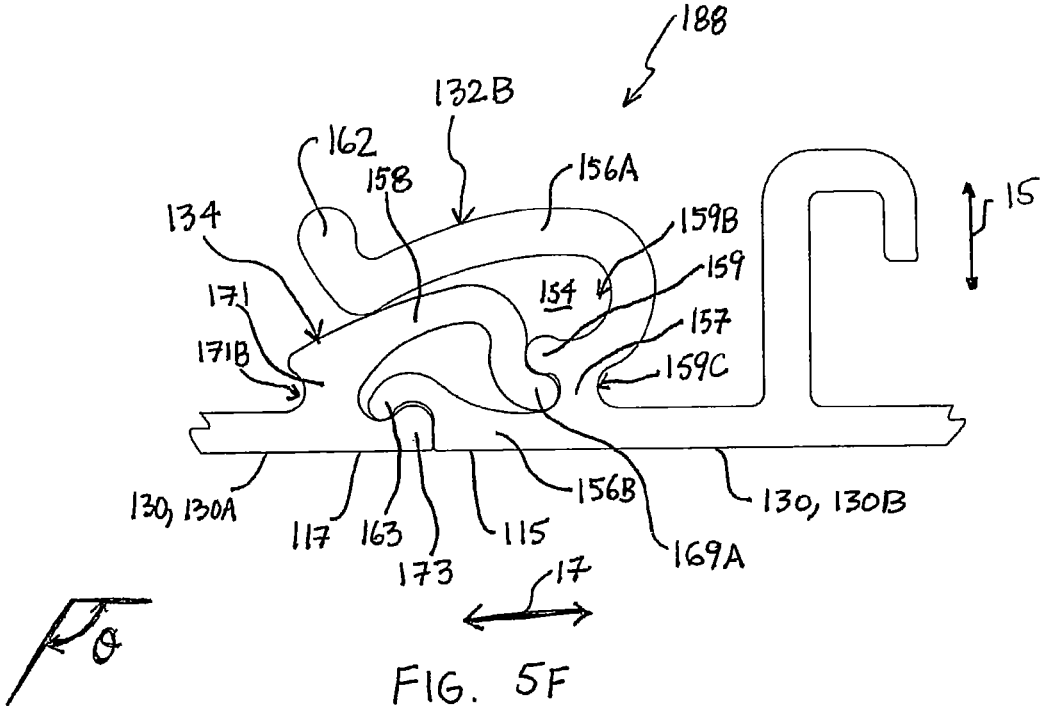

In the illustrated embodiment, the initial engagement between connector components 132B, 134 may comprise a loose-fit connection or partially locked configuration 188 of connector components 132B, 134 (FIG. 5F). In some embodiments, loose-fit connection 188 may be achieved without substantial deformation of connector components 132B, 134 and/or without substantial friction therebetween. In some embodiments, achieving loose-fit connection 188 between connector components 132B, 134 may involve minimal deformation of connector components 132B, 134, but connector components 132B, 134 may return to their undeformed state when loose-fit connection 188 is achieved (FIG. 5F). Once connector components 132B, 134 are in loose-fit connection 188, clip 133 may be placed over connector components 132B, 134 and resiliently deformed around one or more parts of connector components 132B, 134 (FIGS. 5G-5H) to reach a configuration where restorative deformation forces associated with clip 133 (e.g. arms 135A, 135B) cause clip 133 to form a snap-together fitting over connector components 132B, 134 as shown in FIG. 5I. FIG. 5I shows connector components 132B, 134 and clip 133 in their locked configuration, which may be referred to as connection 150B.

The features of connector components 132B, 134 of the illustrated embodiment are shown best in FIG. 5A. Connector component 132B is a part of (i.e. integrally formed with) panel 130B and includes a pair of contoured arms 156A, 156B which join one another in neck region 157 but are spaced apart from one another at their opposing ends to form principal receptacle 154. In the illustrated embodiment, neck region 157 comprises a projection 159 which projects into principal receptacle 154 to define a secondary receptacle 159B within principal receptacle 154. Neck region 157, arm 156B and a remainder of panel 130B define a pair of opposing concavities 159A, 159C. Arm 156A comprises a protrusion 162 at its distal end 156A'. Protrusion 162 is curved in a direction opposing the curvature of the remainder of arm 156A to define a concavity 160. Arm 156B comprises a thumb 163 at its distal end 156B'. Protrusion 162 and thumb 163 project generally away from one another to define an opening 165 to principal receptacle 154. In the illustrated embodiment, thumb 163 is shaped to provide a secondary receptacle 167 located outside of primary receptacle 154.

Connector component 134 is a part of (i.e. integrally formed with) panel 130A and includes a principal protrusion 158 and a thumb 173. Principal protrusion 158 is contoured and, in the illustrated embodiment, principal protrusion 158 comprises a pair of secondary protrusions 169A, 169B and a neck section 171. Principal protrusion 158 and thumb 173 are spaced apart from one another at their opposing ends to form a receptacle or recess 155. Neck section 171, thumb 173 and a remainder of panel 130A define a pair of opposing concavities 171A, 171B. Secondary protrusion 169A is curved in a direction opposing the curvature of the remainder of principal protrusion 158 to define a further concavity 175.

Methods for joining connector components 132B, 134 to achieve an initial engagement (e.g. loose-fit connection) 188 according to particular embodiments are now described in more detail with reference to FIGS. 5A-5C and 5E-5F. As shown in FIGS. 5A-5C and 5E-5F, panels 130A, 130B may be moved toward one another to push connector component 134 into receptacle 154 of connector component 132B with minimal deformation of connector components 132B, 134 and with minimal or no friction between connector components 132B, 134. This lack of substantial deformation and friction facilitates joining of panels 130A, 130B, with minimal pivoting and/or sliding of panels 130A, 130B relative to one another.

Initially, as shown in FIG. 5A, panels 130A, 130B are separated from one another. Panels 130A and 130B may be aligned so that they are substantially in the same plane and edge 117 of panel 130A is generally parallel to edge 115 of panel 130B. A user brings panels 130A, 130B toward one another such that connector component 134 along edge 117 of panel 130A approaches connector component 132B along edge 115 of panel 130B.

Panels 130A, 130B are then moved relative to one another so that secondary protrusion 169A of connector component 134 is pushed toward and into opening 165 to principal receptacle 154 of connector component 132B. As secondary protrusion 169A is pushed toward and into opening 165, secondary protrusion 169A eventually contacts and pushes against thumb 163 at distal end 156B' of arm 156B, and distal portion 177 of principal protrusion 158 contacts and pushes against distal end 156A' of arm 156A (FIG. 5B). Such contact may cause some limited deformation of arm 156A so that distal end 156A' moves in the direction indicated by arrow 183 (FIG. 5B). Such contact may also cause limited deformation of arm 156B so that thumb 163 moves in the direction indicated by arrow 184 (FIG. 5B). The limited deformation of arms 156A, 156B enlarges opening 165 to permit passage of distal portion 177 of principal protrusion 158 through opening 165. Distal portion 177 eventually moves past thumb 163 and approaches concavity 159A within principal receptacle 154 (FIG. 5C).

Because of the above-described limited deformation of arms 156A, 156B of connector component 132B during relative motion of panels 130A, 130B, restorative deformation forces (i.e. the forces that tend to restore connector component 132B to its original non-deformed configuration) may help the user force secondary protrusion 169A into concavity 159A. As the restorative deformation forces act on connector component 132B to help the user force secondary protrusion 169A into concavity 159A, thumb 173 tends to move into secondary receptacle 167 and thumb 163 tends to move into concavity 171A (FIGS. 5E-5F). The movement of thumbs 163, 173 into concavity 171A and secondary receptacle 167 may also involve limited deformation of thumbs 163, 173 or other portions of connector components 132B, 134 as thumbs 163, 173 slide past one another. Thumbs 163, 173 may have smooth contoured surfaces to assist thumbs 163, 173 to slide past one another and/or to assist with limited deformation of thumbs 163, 173, as principal protrusion 158 is inserted in principal receptacle 154.

With this movement, connector components 132B, 134 achieve the loose-fit connection 188 shown in FIG. 5F. Between the configuration of FIG. 5E and loose-fit connection 188 of FIG. 5F, there may be a limited relative linear or generally linear motion of panels 130A, 130B (e.g. in the direction of arrow 185 of FIG. 5E) as the various aforementioned parts of connector components 132B, 134 move into the loose-fit connection 188. As connector components 132B, 134 approach their loose-fit connection 188 (FIG. 5F), connector components 132B, 134 may return to their undeformed states (i.e. any limited deformation associated with moving components 132B, 134 into loose-fit connection 188 may be relaxed so that connector components 132B, 134 return to their undeformed states once loose-fit connection 188 is achieved). In loose-fit connection 188 of the illustrated embodiment (FIG. 5F), connector components 132B, 134 are loosely connected or engaged with each other and may be capable of limited relative motion. For example, when connector components 132B, 134 are arranged in the loose-fit connection 188, panels 130A, 130B may pivot relative to one another (the user may effect relative pivotal movement of panels 130A, 130B so that the relative interior angle θ between panels 130A, 130B may vary between 180° as shown in FIG. 5F and approximately 90°). Also, when connector components 132B, 134 are arranged in the loose-fit connection 188, panels 130A, 130B may be slid relative to one another in longitudinal direction 19 (into and out of the page in FIG. 5F) without substantial friction between connector components 132B, 134 and without substantial deformation of connector components 132B, 134.

In the loose-fit connection 188 of the illustrated embodiment (FIG. 5F), connector components 132B, 134 are engaged to one another in a partially locked configuration in the sense that deformation of one or both of connector components 132B, 134 may be required to pull connector components 132B, 134 apart. Loose-fit connection 188 of connector components 132B, 134 may retain principal protrusion 158 of connector component 134 in receptacle 154 of connector component 132B, such that connector components 132B, 134 are prevented from separating under the application of limited forces in particular directions (i.e. forces incapable of deforming connector components 132B, 134 to sufficient degree). By way of non-limiting example, in particular embodiments, once engaged in a loose-fit connection 188, connector components 132B, 134 cannot be separated by the force of gravity acting on one of two panels 130A, 130B in a transverse direction 17 (i.e. the weight of panels 130A, 130B applied in transverse direction 17 will not cause sufficient deformation of connector components 132B, 134 to permit connector components 132B, 134 to separate).

Another method of connecting connector components 132B, 134 to form loose-fit connection 188 (FIG. 5) is shown in FIG. 5D. Panels 130A, 130B may be initially oriented so that the relative angle θ between panels 130A, 130B is in a range of 90° to 150°. In other embodiments, panels 130A, 130B may be initially oriented so that the relative angle θ between panels 130A, 130B is in a range of 120° to 150° A distal portion 177 of principal protrusion 158 is inserted into principle receptacle 154 (FIG. 5D). By way of non-limiting example, connector components 132B, 134 may be placed in this initial (FIG. 5D) configuration by relative sliding of panels 130A, 130B in the longitudinal direction. A user then effects relative pivotal (or quasi-pivotal) motion (see arrow 126) between panels 130A, 130B (or, more particularly, connector components 132B, 134) until secondary protrusion 169A moves into concavity 159A, thumb 173 moves into secondary receptacle 167 and thumb 163 moves into concavity 171A, thereby achieving loose-fit connection 188 (FIG. 5F) between connector components 132B, 134.

Figure 5G:
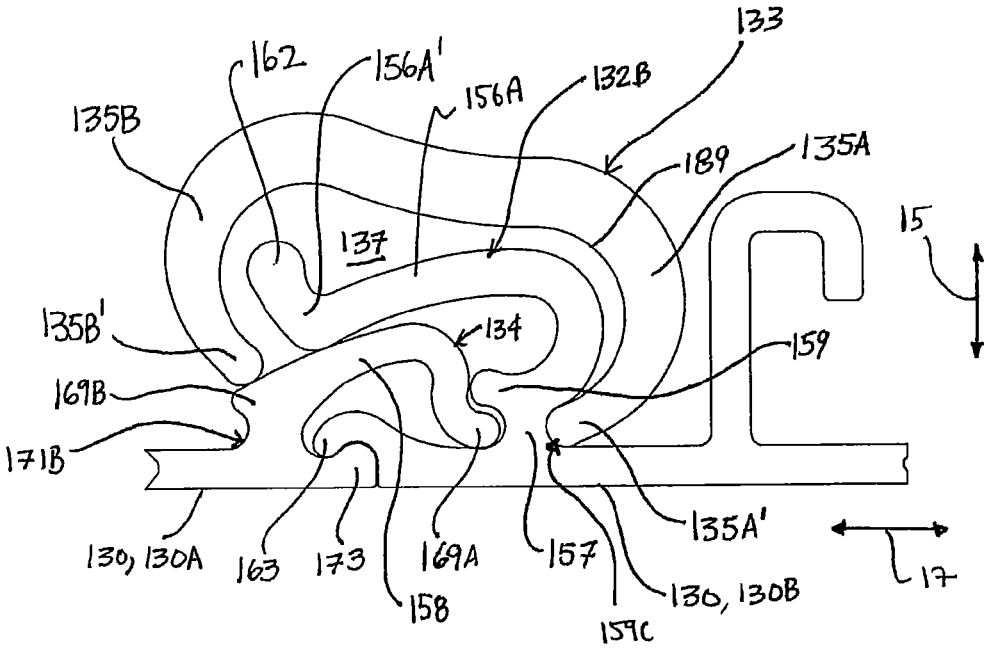

Once connector components 132B, 134 are in the loose-fit connection 188 of FIG. 5F (by the method illustrated in FIGS. 5A, B, C and E, by the method illustrated in FIG. 5D or any other suitable method), a clip 133 may be placed or seated loosely onto connector components 132B, 134 as shown in FIG. 5G. In some embodiments, clip 133 has substantially the same longitudinal dimension (i.e. into and out of the page in the illustrated views) as connector components 132B, 134, and clip 133 is aligned so that it extends substantially along the longitudinal dimension of connector components 132B, 134. In the illustrated embodiment, clip 133 comprises a pair of opposing contoured arms 135A, 135B which initially extend away from one another and which curve toward one another at their distal ends 135A', 135B'. Arms 135A, 135B of clip 133 define a recess, receptacle or concavity 137 for receiving connector components 132B, 134. In the illustrated embodiment, arms 135A, 135B are contoured such that the transverse spacing (direction 17) between arms 135A, 135B is greater in at least some regions of the interior of receptacle 137 than at the entrance to receptacle 137 (i.e. between distal ends 135A', 135B' of arms 135A, 135B).

Figure 5H:
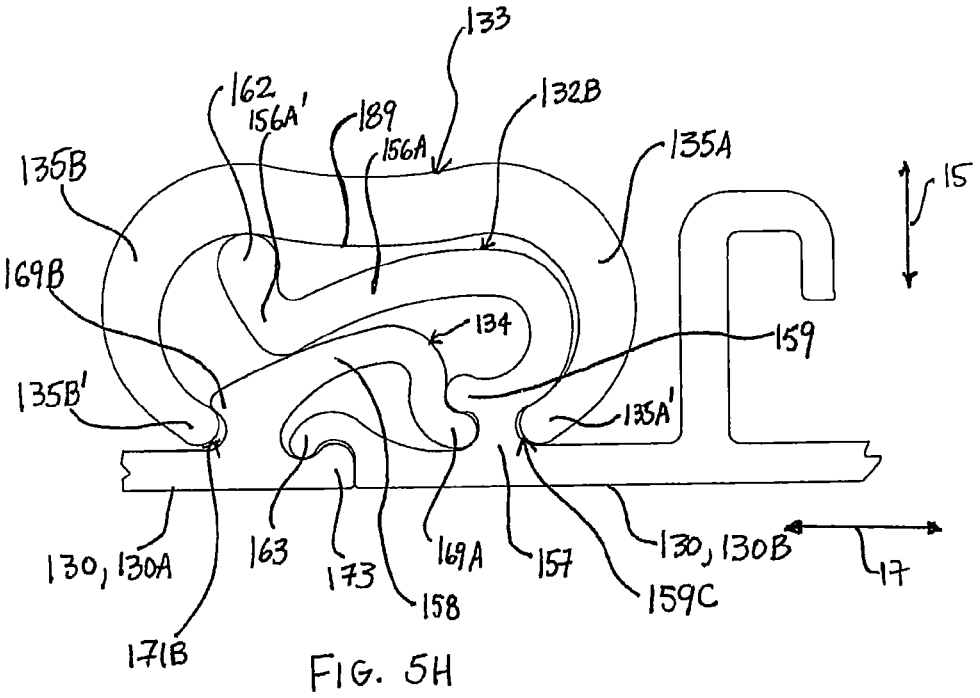
Figure 5I:
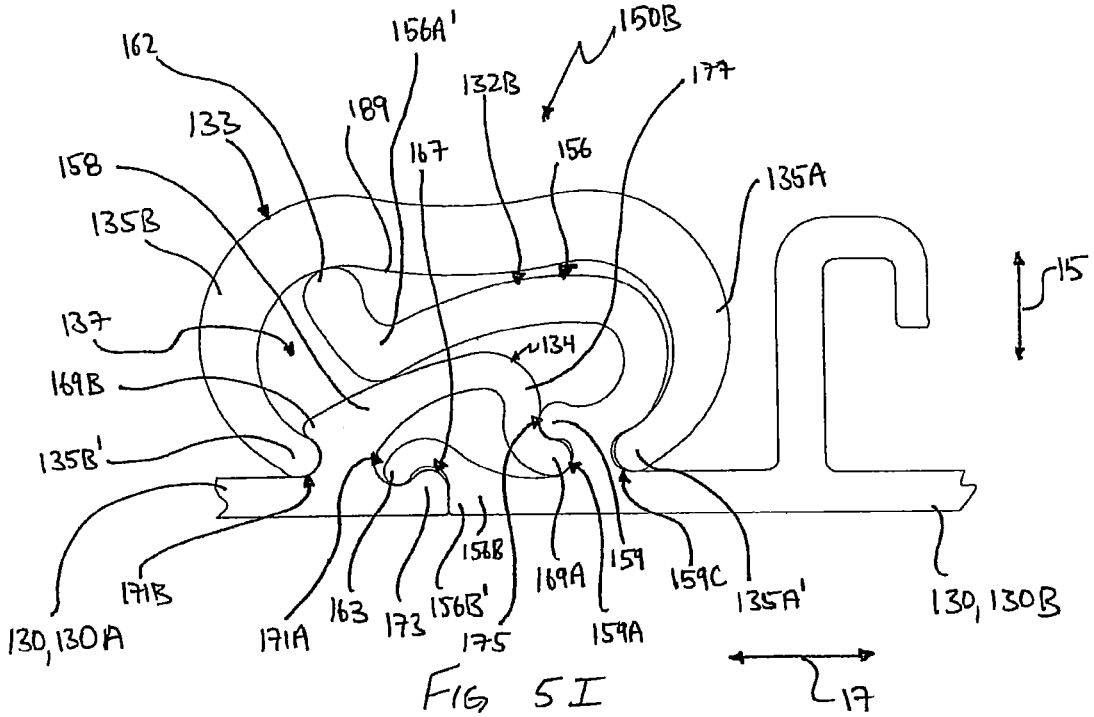

FIGS. 5G-5H illustrate one method of connecting clip 133 to connector components 132B, 134 to form connection 150B according to a particular embodiment. FIG. 5G illustrates an initial, loosely seated configuration wherein connector components 132B, 134 are partially received in receptacle 137 of clip 133, arm 135A of clip 133 extends around arm 156A of connector component 132B toward neck region 157 and distal end 135A' of arm 135A is initially positioned in concavity 159C of connector component 132B. In the illustrated view of FIG. 5G arm 135B of clip 133 extends around distal end 156A' of arm 156A of connector component 132B such that distal end 135B' of arm 135B abuts secondary protrusion 169B of connector component 134B. The initial loosely seated configuration of FIG. 5G represents one particular embodiment, where clip 133 is initially oriented at an angle relative to its final locked configuration (FIG. 5I). In other embodiments, clip 133 may be initially loosely seated in an angular configuration similar to that of its final locked configuration (FIG. 5I), in which case distal end 135A' of arm 135A will not be initially located in concavity 159C, but may instead contact connector component 132B somewhere on arm 156A.

Clip 133 may be pushed, rotated or otherwise forced toward panels 130A, 130B so that portions of arms 135A, 135B are forced against portions of connector components 132B, 134. Connector components 132B, 134 may be shaped such that this force and corresponding contact cause deformation of clip 133 in a manner such that portions of arms 135A, 135B (including distal ends 135A', 135B') move apart from one another to wrap around portions of connector components 132B, 134. Because of the deformation of clip 133, restorative deformation forces associated with clip 133 (e.g arms 135A, 135B) tend to force distal end 135B' of arm 135B into concavity 171B once distal end 135B' of arm 135B passes secondary protrusion 169B (see FIG. 5H). These restorative deformation forces are the forces that tend to restore clip 133 to its original non-deformed configuration and may provide clip 133 with a "snap-together" fitting over connector components 132B, 134. Similarly, the restorative deformation forces associated with clip 133 tend to move distal end 135A' of arm 135A into concavity 159C (to the extent that it is not there already). Connector components 132B, 134 thereby extend into receptacle 137 of clip 133, and connector components 132B, 134 are retained by clip 133 in a locked, snap-together configuration (FIG. 5I) where restorative deformation forces associated with clip 133 tend to respectively force the arms 135A, 135B of clip 133 into concavities 159C, 171B of connector components 132B, 134.

Moving clip 133 between its loosely seated configuration (FIG. 5G) and its locked configuration (FIG. 5I) involves deformation of clip 133 as discussed above, but may also involve some deformation of one or more portions of connector components 132B, 134 (e.g. protrusion 162). In the locked configuration of FIG. 5I, the restorative deformation forces associated with clip 133 and possibly connector components 132B, 134 tend to force distal end 135A' of arm 135A against neck region 157 (concavity 159C) of connector component 132B, distal end 135B' of arm 135B against neck region 171 (concavity 171B) of connector component 134 and possibly protrusion 162 against inside surface 189 of clip 133. These points of contact tend to inhibit relative pivotal movement of panels 130A, 130B and relative sliding movement of panels 130A, 130B or clip 133 in longitudinal directions (i.e. into and out of the page in FIG. 5I). These points of contact also tend to inhibit relative movement or separation of panels 130A, 130B or clip 133 in the transverse directions 17 and in the inward-outward directions 15 (see FIG. 5I).

In particular embodiments, a slidable key 161 (FIGS. 7-9) may be used to aid in rotating, pushing or otherwise forcing clip 133 onto connector components 132B, 134 to achieve the snap-together fitting of clip 133 with connector components 132B, 134 and to thereby form connection 150B. For example, a slidable key 161 may be used to cause clip 133 to move from the loosely seated configuration (e.g. FIG. 5G or some other loosely seated configuration) into the locked configuration of FIG. 5I.

Figure 7A:
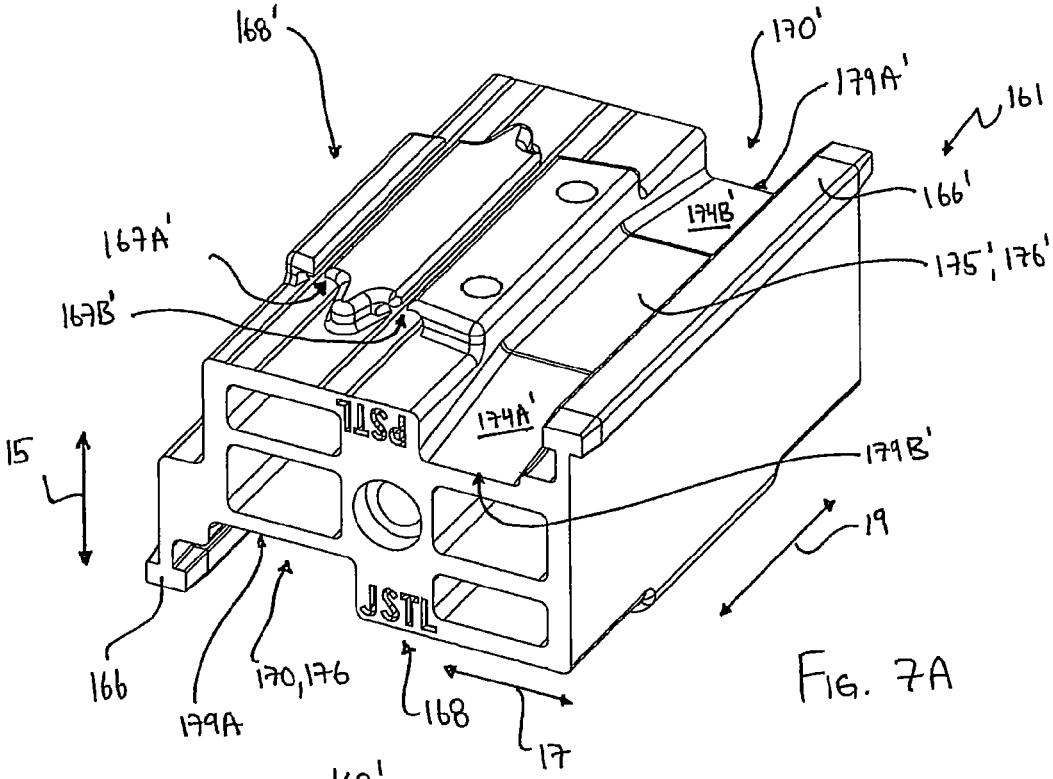
FIGS. 7A-7B (collectively FIG. 7) are perspective and elevation views of a slidable key which may be used to help couple a clip to the FIG. 5 connector components and to thereby implement particular edge-to-edge connections between adjacent panels of the forms of FIGS. 3 and 4.
Figure 7B:
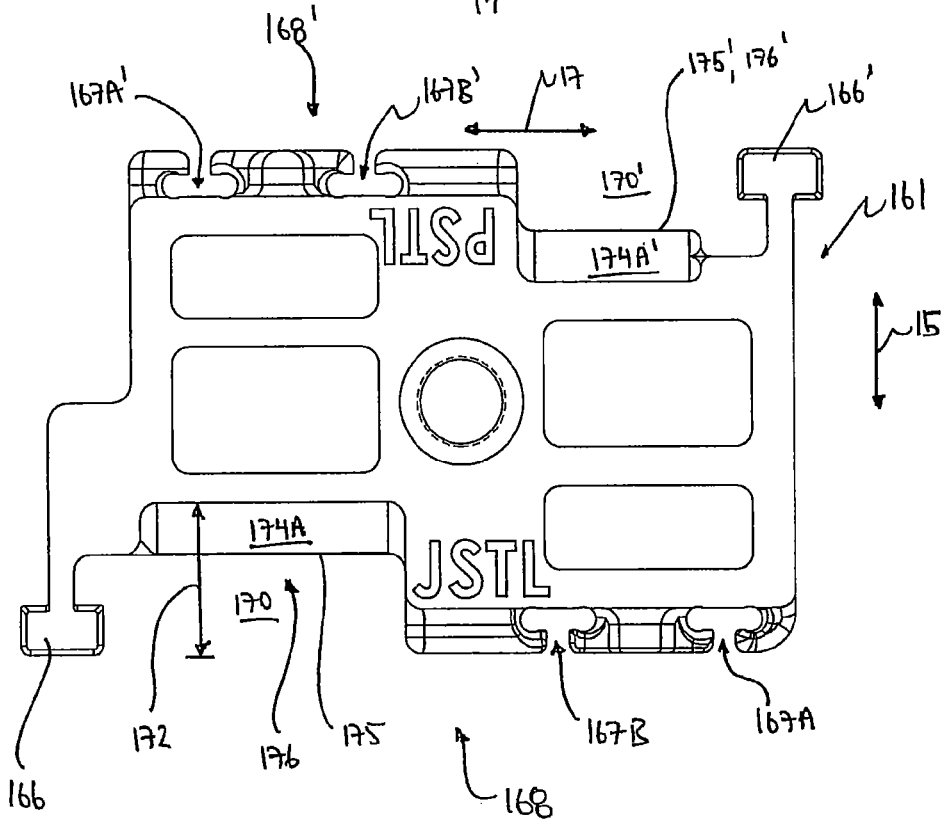
Figure 8A:
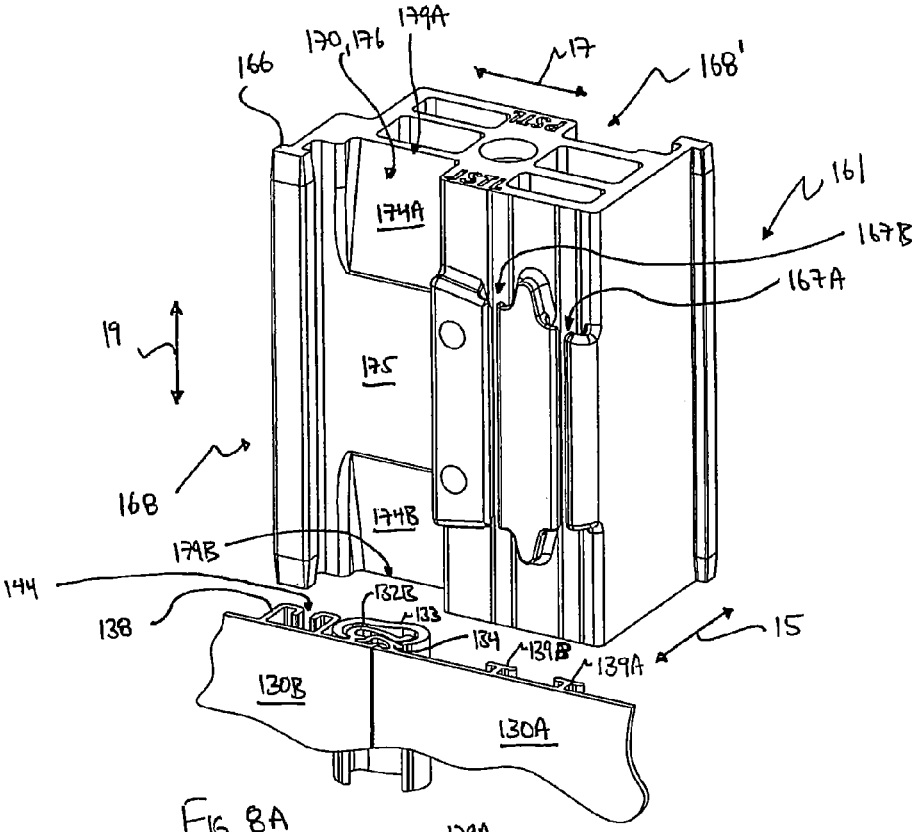
FIGS. 8A-8C (collectively, FIG. 8) show various stages of a method for using the FIG. 7 key to couple a clip to the FIG. 5 connector components and to thereby implement particular edge-to-edge connections between adjacent panels of the forms of FIGS. 3 and 4.
Figure 8B:
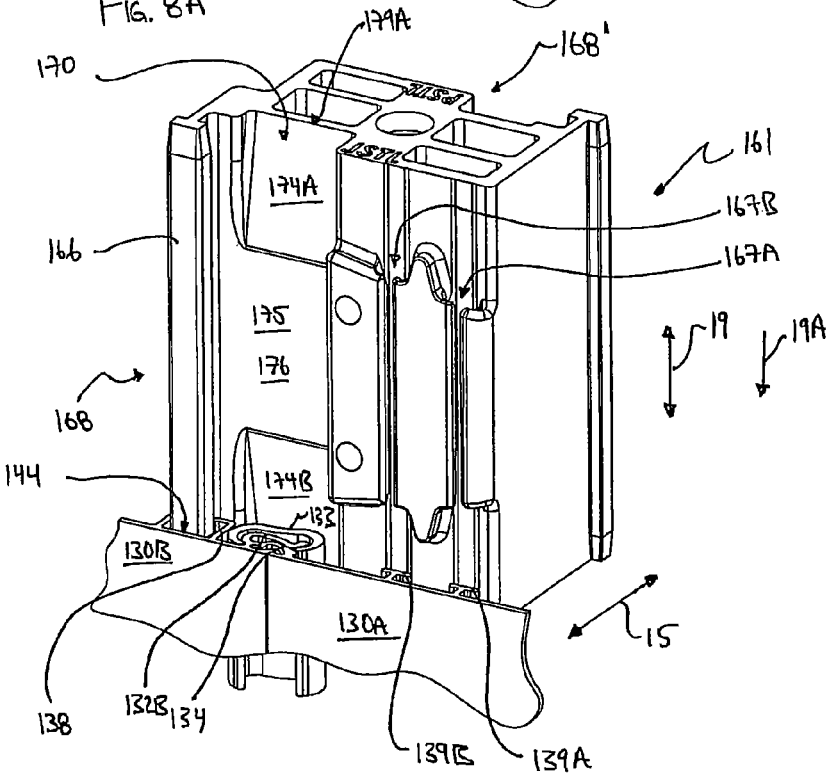
Figure 8C:
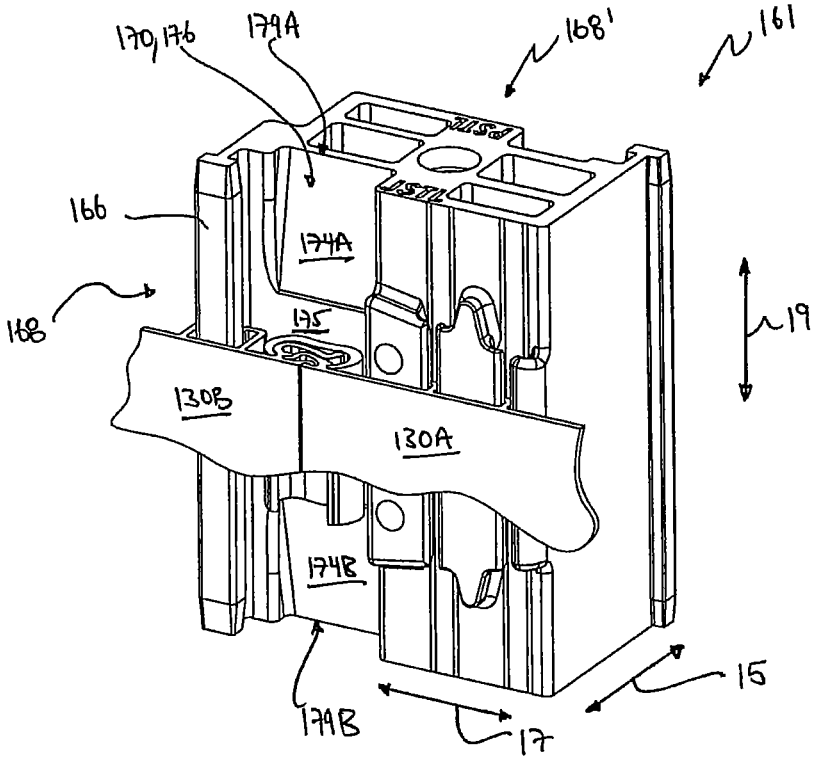

A slidable key 161 according to a particular embodiment is shown in FIGS. 7A and 7B and is shown in use in FIGS. 8A-8C. Key 161 comprises: one or more connector components 166, 167A, 167B, which slidably engage one or more corresponding connector components 138, 139A, 139B on panels 130A, 130B to slidably couple key 161 to a pair of edge-adjacent panels 130; and a clip-coupling component 176 which acts to couple clip 133 to connector components 132B, 134 and to thereby form connections 150B between edge-adjacent panels 130. In the illustrated embodiment, key 161 comprises two sides 168 and 168' which are similar to one another. Side 168 of key 161 comprises connector components 166, 167A, 167B and clip-coupling component 176; side 168' comprises similar connector components 166', 167A', 167B' and clip-coupling component 176', except that the side 168' connector components 166', 167A', 167B' and clip-coupling component 176' have different sizes and/or spacings to facilitate use with different panels 130. In the illustrated views, the features of side 168' are provided with the same reference numerals as the features of side 168, except that the features of side 168' have the prime (') symbol appended thereto. The features of side 168 and the use of these features are described in this description with the understanding that the features of side 168' may be similar and be used in a similar manner to those of side 168. In other embodiments, key 161 may be one sided or may have identical features on both sides 168, 168'.

In currently preferred embodiments, key 161 comprises one or more connector components 166, 167A, 167B on either transverse side of clip-coupling component 176 for connection to one or more corresponding connector components 138 on panel 130A and to one or more corresponding connector components 139A, 139B on edge-adjacent panel 130B. This arrangement helps to prevent key 161 from rotating when force is used to force clip 133 into engagement with connector components 132B, 134. In the illustrated embodiment of FIGS. 7-9, key 161 comprises: a male, T-shaped connector component 166 on a first side of clip-coupling component 176 for engaging a corresponding female, double-J shaped connector component 138 on panel 130B through slot 144 (FIG. 8A); and a pair of female channels 167A, 167B on the opposing transverse side of clip-coupling components 176 for receiving one or more corresponding male, T-shaped connector components 139A, 139B from panel 130A (FIG. 8A).

Figure 9:
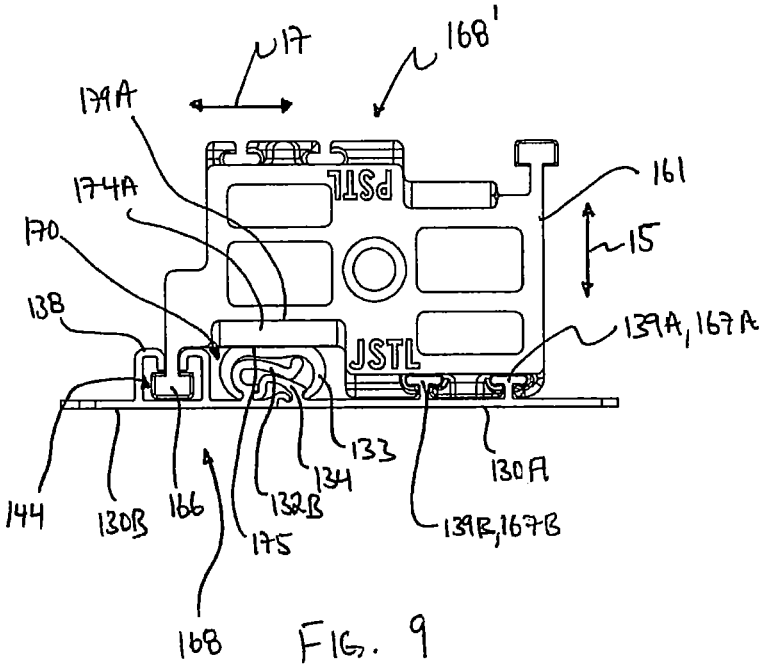
FIG. 9 shows the FIG. 7 key being used to couple a clip to the FIG. 5 connector components to implement particular edge-to-edge connections between adjacent panels of the forms of FIGS. 3 and 4.

FIGS. 8B, 8C and 9 show connector components 166, 167A, 167B of key 161 in engagement with corresponding connector components 138, 139A, 139B of panels 130. In this configuration, key 161 may be slid in the longitudinal direction (indicated by double-headed arrow 19) relative to panels 130 without substantial deformation of key 161 or panels 130 and without substantial friction therebetween. As key 161 slides in longitudinal direction 19 relative to panels 130, the relative position of key 161 and panels 130 in the inward-outward direction (indicated by double-headed arrow 15) is generally fixed by the engagement of 166, 167A, 167B of key 161 with corresponding connector components 138, 139A, 139B of panels 130.

In the illustrated embodiment, clip-coupling component 176 comprises: a recess or channel 170 for receiving clip 133 and connector components 132, 134; and a raised portion 175 within channel 170, where the depth 172 of channel 170 (as measured in inward-outward direction 15) is reduced. In the illustrated embodiment, inclined base portions 174A, 174B (located between raised portion 175 and opposing ends 179A, 179B of channel 170) provide channel 170 with an inclined base which ramps from its maximum depth 172 at its ends 179A, 179B to its minimum depth 172 at raised portion 175. With inclined base portions 174A, 174B, the depth 172 of channel 170 is greater at or near its ends 179A, 179B than at its raised portion 175. This shape of the base of channel 170 facilitates the coupling of connector components 166, 167A, 167B of key 161 to corresponding connector components 138, 139A, 139B of panels 130. As explained in more detail below, key 161 operates by sliding in longitudinal direction 19 relative to panels 130, such that the base of channel 170 (including one of inclined base portions 174A, 174B and/or raised portion 175) contacts clip 133 and forces clip 133 from its loosely seated configuration (e.g. FIG. 5F) into its locked configuration (FIG. 5I) over connector components 132B, 134. Contact between clip 133 and one of inclined base portions 174A, 174B may provide mechanical advantage when forcing clip 133 into engagement with connector components 132B, 134, as clip 133 ramps up the inclined base portion 174A, 174B as key 161 slides in longitudinal direction 19. Providing key 161 with a pair of inclined base portions 174A, 174B permits key to be used from either end of panels 130. In some embodiments, however, clip-coupling component 176 may be provided with a single inclined base portion 174A, 174B.

Operation of key 161 in accordance with a particular embodiment to cause clip 133 to engage connector components 132B, 134 and to thereby form connections 150B between adjacent panels 130 is shown in FIGS. 8A-8C. Connector components 132B, 134 of adjacent panels 130 are placed in loose-fit connection 188 (e.g. FIG. 5F or some other suitable loose fit configuration) and then, as shown in FIG. 8A, clip 133 is placed over connector components 132B, 134 in a loosely seated configuration. In the loosely seated configuration, clip 133 may be seated on connector components 132B, 134 without deforming clip 133 or connector components 132B, 134 (see FIG. 5G for a non-limiting example of a loosely seated configuration). Key 161 is moved in longitudinal direction 19 relative to panels 130, so that connector components 166, 167A, 167B of key 161 slidably engage corresponding connector components 138, 139A, 139B of panels 130 (FIGS. 8B, 8C) and so that clip 133 and connector components 132B, 134 are received in channel 170 of clip-coupling component 176. At ends 179A, 179B of recess 170, depth 172 of recess 170 is deep enough so that key 161 may be initially slidably coupled to panels 130 without substantial friction or deformation between key 161 and panels 130 and without substantial friction or deformation between key 161 and clip 133 and/or connector components 132B, 134.

A user then pushes or pulls on key 161 to effect sliding of key 161 (relative to panels 130) in longitudinal direction 19 as shown in FIG. 8B. In the illustrated view of FIG. 8B, key 161 is slid in direction 19A relative to panels 130. At some point in the relative sliding movement of key 161, inclined base portion 174B and/or raised portion 175 of channel 170 contacts clip 133. Since the relative positions of key 161 and panels 130 are fixed in inward-outward direction 15 by the engagement of connector components 166, 167A, 167B of key 161 and corresponding connector components 138, 139A, 139B of panels 130, the contact between clip 133 and inclined base portion 174B and/or raised portion 175 tends to force clip 133 toward connector components 132B, 134, causing clip 133 to deform and snap into its locked configuration over connector components 132B, 134 (FIG. 8C)—i.e. thereby forming connection 150B between connector components 132B, 134. After clip 133 is snapped into the locked configuration, key 161 may be slidably disconnected from panels 130 by sliding key in one of longitudinal directions 19 relative to panels 130, so that key 161 can be re-used in aiding in the forming of other connections 150B.

It will be appreciated that key 161 may be used to couple clip 133 to connector components 132B, 134 by sliding key 161 in either longitudinal direction 19 relative to panels 130, particularly, when key 161 comprises a pair of inclined base portions 174A, 174B.

In particular applications (e.g. for the formation of cast-in-place walls), the extension of panels 130 and clip 133 in longitudinal direction 19 may be relatively large (e.g. greater than may be conveniently reached by the arms of a typical user). In such cases, key 161 may be pivotally or fixedly mounted to an extended arm (not shown) which may be used to help slide key 161 over the longitudinal extent of panels 130. In some cases, this extended arm may be telescopically or otherwise extendable.

In other embodiments, key 161 may have different configurations of connector components for slidably coupling key 161 to different configurations of panels 130. In general, where panels 130 include other connector components on one or both sides of connector components 132B, 134, key 161 may incorporate any suitable complementary connector components for slidably engaging with these connector components of edge-adjacent panels 130.

It will be appreciated that key 161 is optional and is not necessary to implement connections 150B. Clip 133 may be pushed or otherwise forced into a snap-fitting connection with connector components 132B, 134 using another suitable tool (e.g. pliers, hammer, block of wood or the like), or manually, without the aid of tools.

Figure 6A:
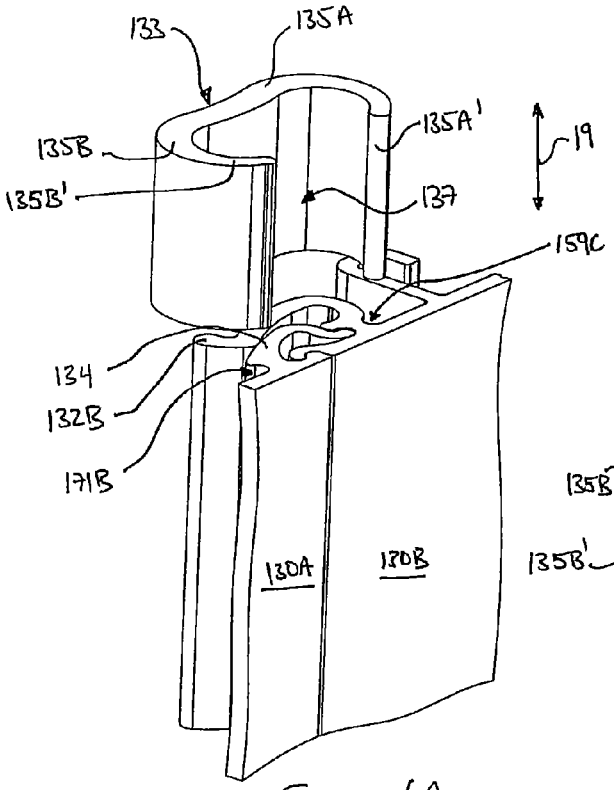
FIGS. 6A-6C (collectively, FIG. 6) represent various partial perspective views showing another method for coupling a clip to the FIG. 5 connector components to thereby implement particular edge-to-edge connections between adjacent panels of the forms of FIGS. 3 and 4.
Figure 6B:
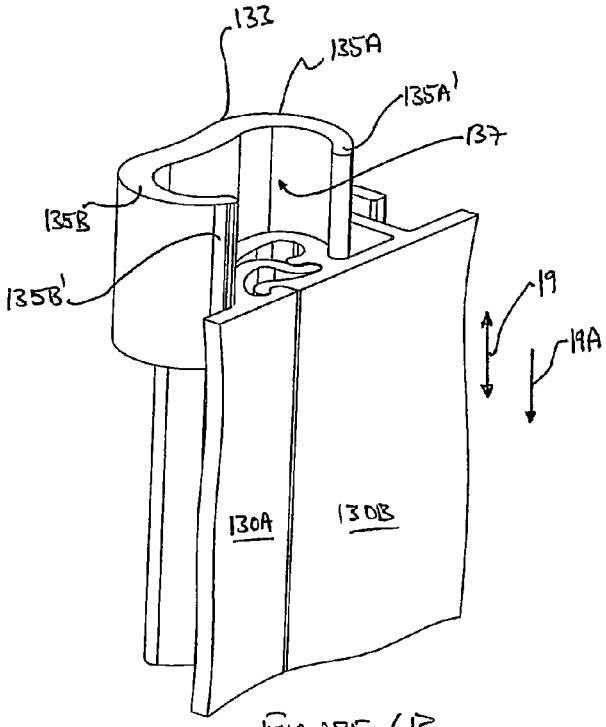
Figure 6C:
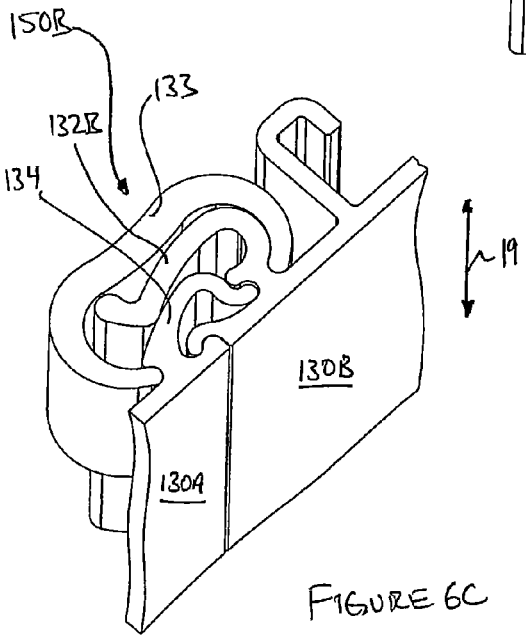

FIGS. 6A-6C show a method of coupling clip 133 to connector components 132B, 134 to form connection 150B according to another embodiment wherein clip 133 is slid over connector components 132B, 134 in the longitudinal direction 19. The method of FIGS. 6A-6C may be used where the deformation associated with coupling clip 133 to connector components 132B, 134 is relatively low and/or the restorative deformation forces associated with clip 133 when clip 133 is in its locked configuration (FIG. 5I) are relatively low and/or when the frictional forces between clip 133 and connector components 132B, 134 are relatively low. Initially, as shown in FIG. 6A, clip 133 is spaced apart from panels 130A, 130B in longitudinal direction 19. A user then positions clip 133 so that distal end 135A' of arm 135A is aligned with concavity 159C and distal end 135B' of arm 135B is aligned with concavity 171B. The user moves clip 133 in the longitudinal direction indicated by arrow 19A (FIG. 6B) such that distal end 135A' of arm 135A is received within concavity 159C and distal end 135B' of arm 135B is received within concavity 171B. The movement of clip 133 into the FIG. 6B configuration may involve some deformation of arms 135A, 135B. The user then pushes or applies force on clip 133 in the direction indicated by arrow 19A to slide clip 133 onto connector components 132B, 134, as shown in FIGS. 6B-6C, until clip 133 reaches its desired longitudinal orientation (e.g. clip 133 extends over the longitudinal dimension of connector components 132B, 134). Pushing clip 133 in longitudinal direction 19A (i.e. between the configurations of FIGS. 6B and 6C) may involve overcoming the friction between clip 133 and connector components 132B, 134.

In the locked configuration such as shown in FIGS. 5I and 8C, connector components 132B, 134 and/or clip 133 may be deformed from their nominal states, such that restorative deformation forces tend to force one or more of: distal end 156A' of arm 156A against principal protrusion 158; secondary protrusion 169A into concavity 159A; thumb 173 into secondary receptacle 167; thumb 163 into concavity 171A; distal end 135A' of arm 135A into concavity 159C; distal arm 135B' of arm 135B into concavity 171B; and protrusion 162 against clip 133. However, preferably, the strain associated with this deformation on connector components 132B, 134 and clip 133 is preferably not sufficient to degrade the integrity of connector components 132B, 134 and clip 133.

When connection 150B is formed between connector components 132B, 134 and clip 133, connector components 132B, 134 and clip 133 are shaped to provide several interleaving parts. For example, as can be seen from FIG. 5I:

- when secondary protrusion 169A projects into concavity 159A, secondary protrusion 169A is interleaved between contoured arm 156B and projection 159;
- when projection 159 extends into concavity 175, projection 159 is interleaved between secondary protrusion 169A and a remainder of distal portion 177 of principal protrusion 158;
- when thumb 163 projects into concavity 171A, thumb 163 is interleaved between thumb 173 and principal protrusion 158;
- when thumb 173 projects into secondary receptacle 167, thumb 173 is interleaved between thumb 163 and distal portion 156B' of contoured arm 156B;
- when distal end 135A' of contoured arm 135A projects into concavity 159C, distal end 135A' is interleaved between projection 159 and the remainder of panel 130B; and
- when distal end 135B' of contoured arm 135B projects into concavity 171B, distal end 135B' is interleaved between secondary protrusion 169B and a remainder of panel 130A.

The interleaving parts of connector components 132B, 134 and clip 133 provide connection 150B with a resistance to unzipping and prevent or minimize leakage of liquids and, in some embodiments, gases through connector 150B.

In some embodiments, a second sealing material (not shown) may be provided on some surfaces of connector components 132B, 134 and/or clip 133. Such sealing material may be relatively soft (e.g. elastomeric) when compared to the material from which the remainder of panels 130 is formed. In particular embodiments, such sealing material may be provided using a co-extrusion process. In other embodiments, such sealing material may be coated onto selected surfaces of connector components 132B, 134 and/or clip 133 after the formation thereof. Sealing material may help to make connection 150B more impermeable to liquids or gasses. By way of non-limiting example, such sealing material may be provided: on distal end 156A' of arm 156A; in concavity 171B; on secondary protrusion 169A; in concavity 159A; on thumb 173; in secondary receptacle 167; on thumb 163; in concavity 171A; in concavity 159C; on projection 159; in concavity 175; on interior surface 189 of clip 133; and/or on protrusion 162.

Figure 4:
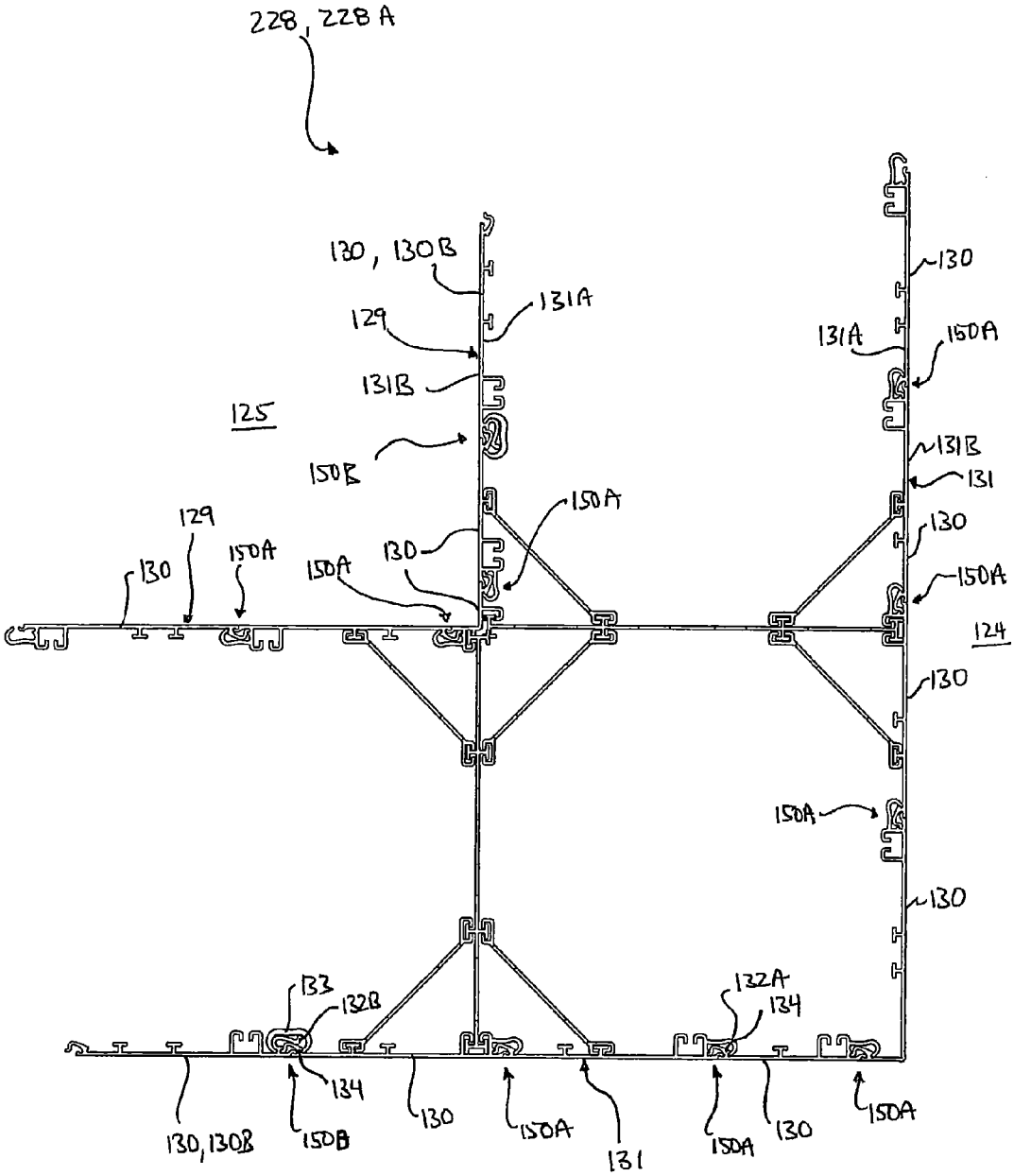
FIG. 4 is a partial top plan view of a portion of a modular stay-in-place form according to another exemplary embodiment.

Connection 150B is described above with reference to form portion 128 in FIGS. 3A-B. Form portion 128 of FIGS. 3A-3B includes a single connection 150B which incorporates a clip 133 coupled to connector components 132B, 134. In general, however, connections similar to connection 150B formed by coupling a clip 133 to a pair of loose fit connector components 132B, 134 may be used to connect any edge-adjacent pair of panels 130 in a form-work. FIG. 4 shows a top plan view of a portion 228 of a form 228A comprising a plurality of panels 130 which are connected in edge-adjacent relationship by way of connections 150A and 150B to form a structure having a first surface 129 and a second surface 131. For example, the structure formed using form portion 228 may comprise a building wall having an interior surface 129 (facing toward an interior 125 of the structure) and an exterior surface 131 (facing toward an exterior 124 of the building structure). Connections 150B incorporating clips 133 connect edge-adjacent panels 130 for two of the connections illustrated in the FIG. 4 form portion 228. One of these connections 150B is along interior surface 129 and the other one of these connections 150B is along exterior surface 131. Connections 150B are not limited to the two connections 150B shown in form portion 228 illustrated in FIG. 4. In other embodiments, connections 150B may be used in the place of any of the panel-to-panel connections 150A shown in FIG. 4 form portion 228. In some embodiments (for example, where it is desired to minimize unzipping or to minimize the leakage of liquid or gas through the connections between edge-adjacent panels 130), all of the edge-to-edge connections between panels 130 of the associated form-work may be connections 150B incorporating a clip which is coupled to a pair of connector components. In particular embodiments, connections 150B may be used in place of one or more of the edge-to-edge connections between panels of any of the form-works described in the '951 PCT Application.

Figures 10A, 10B:
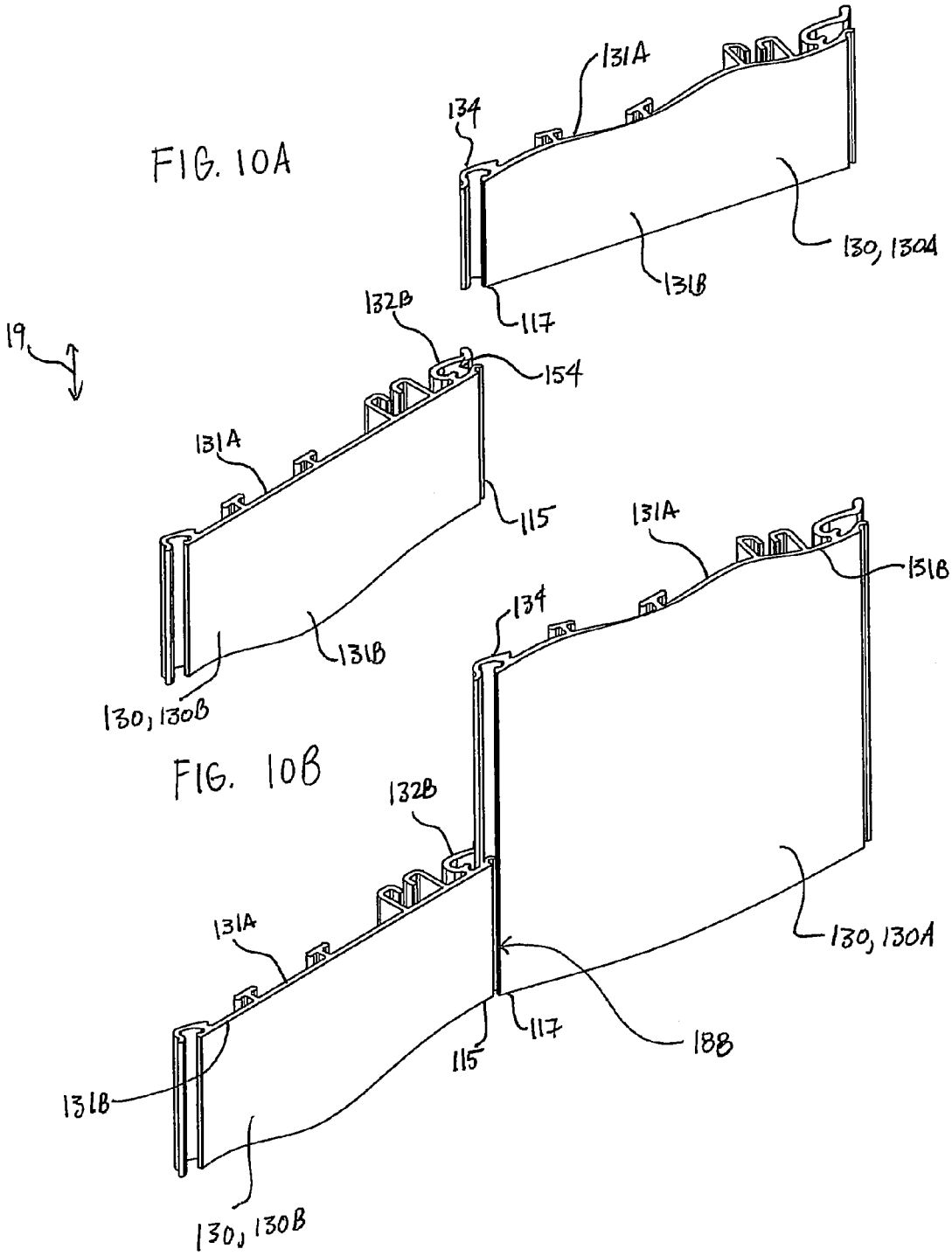
FIGS. 10A-10B (collectively, FIG. 10) represent perspective views of showing yet another method of coupling together the connector components of an edge-adjacent pair of panels.

Another method of connecting together connector components 132B, 134 to achieve a loose-fit connection 188 (e.g. FIG. 5F) is shown in FIGS. 10A-10B. According to this method, panels 130A, 130B are aligned in substantially the same plane, but spaced apart from one another in longitudinal direction 19 (FIG. 10A). Connector component 132B on panel 130B is aligned with connector component 134 on panel 130A. Panels 130A, 130B are then moved toward each other so that connector component 132B is slidably received within receptacle 154 of connector component 134 and connector components 132B, 134 are placed into a loose-fit connection 188. A user may effect longitudinal sliding of panel 130A relative to panel 130B until the panels reach a desired longitudinal alignment. Clip 133 is coupled with connector components 132B, 134 to form a connection 150B between connector components 132B, 134 using one of the methods described above for connecting clip 133 to connector components 132B, 134.

Another method of connecting connector components 132B, 134 and clip 133 to achieve connection 150B is similar to the methods shown in FIG. 5, but is performed in a slightly different order. In this alternate method, clip 133 is loosely seated on connector component 132B prior to coupling connector components 132B, 134 and then connector components 132B, 134 are placed in a loose-fit engagement with one another. Once a loose fit engagement is achieved between connector components 132B, 134, a user applies force to clip 133 (which is already loosely seated on connector component 132B) to force clip 133 into engagement with connector components 132B, 134 and to thereby form connection 150B.

The loose coupling of clip 133 to connector component 132B may be achieved by: longitudinally aligning clip 133 and connector component 132B so that clip 133 is spaced apart from connector component 132B in the longitudinal direction 19; and sliding clip 133, in longitudinal direction 19, onto connector component 132B, until the length of clip 133 extends over connector component 132B, arm 135A of clip 133 extends around contoured arm 156A of connector component 132B and distal end 135A' of arm 135A is received in concavity 159C. Connector component 134 may be subsequently inserted into receptacle 154 of connector component 132B at an angle, similarly to the configuration of FIG. 5D (i.e. panels 130A, 130B are oriented so that the relative interior angle θ between panels 130A, 130B is in a range of 90° to 150° in some embodiments, or between 120° to 150° in other embodiments). The user then effects relative pivotal (or quasi-pivotal) motion between panels 130A, 130B (or, more particularly, connector components 132B, 134) until secondary protrusion 169A moves into concavity 159A, thumb 173 moves into secondary receptacle 167 and thumb 163 moves into concavity 171A, thereby achieving a loose-fit connection 188 between connector components 132B, 134 similar to that of FIG. 5F. During the relative pivotal motion of panels 130A, 130B, clip 133 remains loosely seated on connector component 132B (and also, connector component 134). When connector components 132B, 134 are arranged in loose-fit connection 188, clip 133 may be pushed or otherwise forced onto connector components 132B, 134 using any of the methods described herein for coupling clip 133 to connector components 132B, 134 to form a connection 150B.

Figure 11A:
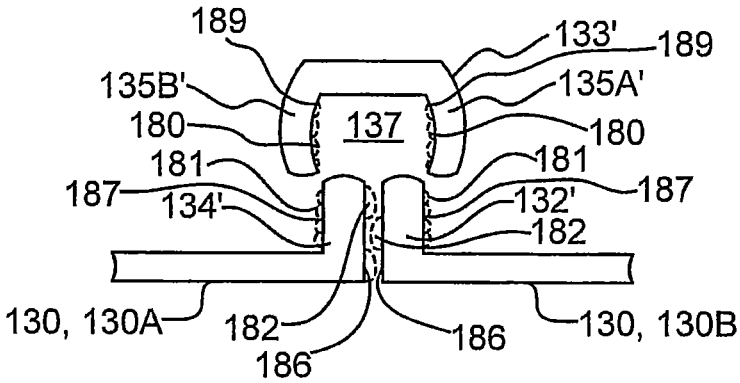
FIGS. 11A-11C (collectively, FIG. 11) represent various elevation views of connector components and a clip for implementing edge-to-edge connections between adjacent panels of a form, according to another embodiment.
Figure 11B:
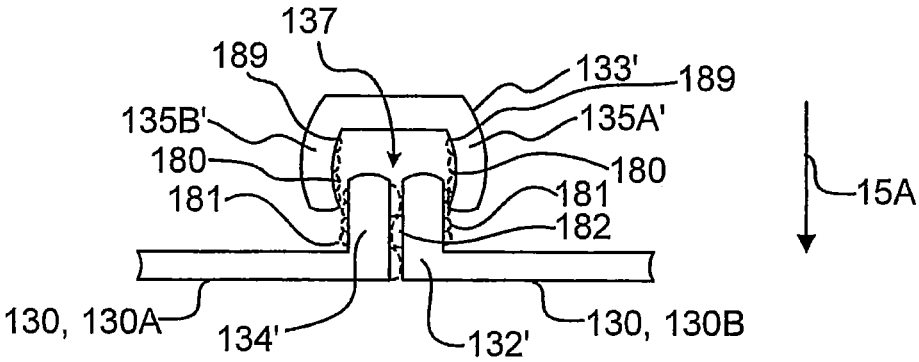
Figure 11C:
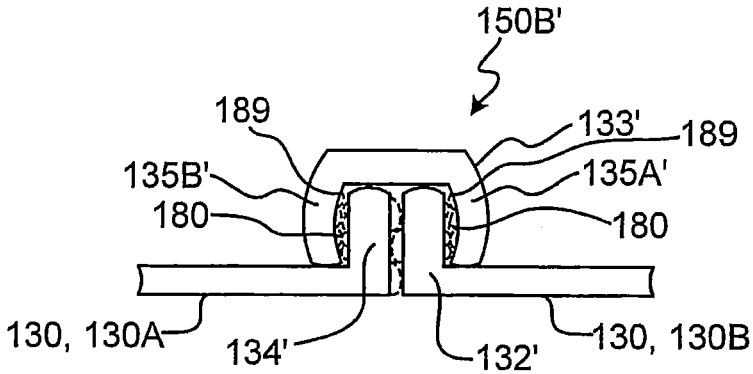

While the above-described embodiments incorporate connector components 132B, 134 coupled together with a clip 133, in yet other embodiments, adjacent panels 130 may incorporate differently shaped connector or edge components along the adjacent edges of panels 130, which are coupled together using a suitably shaped clip. For example, FIGS. 11A-11C show an example embodiment, at various stages of connection, of adjacent panels 130A, 130B which are connected together with a clip 133' to form a connection 150B' between the adjacent panels 130A, 130B. In the FIG. 11A-11C embodiment, panel 130A incorporates an edge component 134' and panel 130B incorporates an edge component 132'. Edge components 132', 134' may include raised edge portions defined by opposing first and second sides 186, 187. Adjacent panels 130A, 130B may be initially aligned so that first sides 186 of edge components 132', 134' are proximate to one another, or engage one another in an abutting relationship (FIG. 11A). Clip 133', which incorporates first and second arms 135A', 135B' defining a receptacle 137 therebetween, is loosely seated on edge components 132', 134' so that receptacle 137 partially receives edge components 132', 134', and arms 135A', 135B' contact second sides 187 of edge components 132', 134', respectively (FIG. 11B). Clip 133' is then pushed or otherwise forced in direction 15A onto edge components 132', 134' so that arms 135A', 135B' deform apart from one another, permitting edge components 132', 134' to further extend into receptacle 137 of clip 133'. FIG. 11C represents a locked configuration, where edge components 132', 134' are fully extended in receptacle 137 of clip 133'. Restorative deformation forces associated with clip 133' (e.g. arms 135A', 135B') tend to force edge components 132', 134' toward one another and to cause clip 133' to retain edge components 132', 134' in the locked configuration of FIG. 11C. In some embodiments, clip 133' may be pushed onto edge components 132', 134' or otherwise forced into the locked configuration shown in FIG. 11C with the assistance of a tool, such as a slidable key (e.g. similar to slidable key 161 described above), pliers, hammer, block of wood or the like.

One or more of the contacting surfaces on edge components 132', 134' and clip 133' optionally incorporate protrusions and/or recesses which interleave with one another to provide one or more of: interlocking of portions of components 132', 134' and/or clip 133'; resistance to unzipping; preventing or minimizing leakage of liquids and, in some instances, gases through connection 150B'. For example:

- first sides 186 may incorporate protrusions and/or recesses to provide an interlocking interface between the first sides 186 of adjacent edge components 132', 134';
- second sides 187 may incorporate protrusions and/or recesses to provide an interlocking interface between second sides 187 and arms 135A', 135B' of clip 133'; and
- clip 133' may have protrusions and/or recesses on its inside surface 189 which engage with second sides 187 of edge components 132', 134'.

In some embodiments, one or more of the contacting surfaces on edge components 132', 134' and clip 133' are textured or shaped to provide the plurality of protrusions and/or recesses described above.

In the illustrated embodiment, first side 186 of edge component 134' includes optional protrusions 182 (shown in dotted lines) for engaging and interlocking with a protrusion 182 (also shown in dotted lines) on first side 186 of edge component 132'. Second side 187 of edge component 132' includes optional protrusions 181 (shown in dotted lines) for engaging with inside surface 189 of arm 135A' of clip 133'. Second side 187 of edge component 134' includes optional protrusions 181 (shown in dotted lines) for engaging with inside surface 189 of arm 135B' of clip 133'. Inside surface 189 of clip 133' has optional protrusions 180 (shown in dotted lines), which engage with second sides 187 of edge components 132', 134'.

In some embodiments, a sealing material (not shown) may be provided on some surfaces of connector components 132', 134' and/or clip 133'. Such sealing material may be relatively soft (e.g. elastomeric) when compared to the material from which the remainder of panels 130 is formed. Such sealing materials may be provided using a co-extrusion process or may be coated onto selected surfaces of connector components 132', 134' and/or clip 133' after the formation thereof. Such sealing materials may help to make connection 150B' impermeable to liquids or gasses. By way of non-limiting example, such sealing materials may be provided: on first sides 186 (or protrusions 182) of edge components 132', 134'; on second sides 187 (or protrusions 181) of edge components 132', 134'; and on inside surface 189 (or protrusions 180) of clip 133.

Figure 12A:
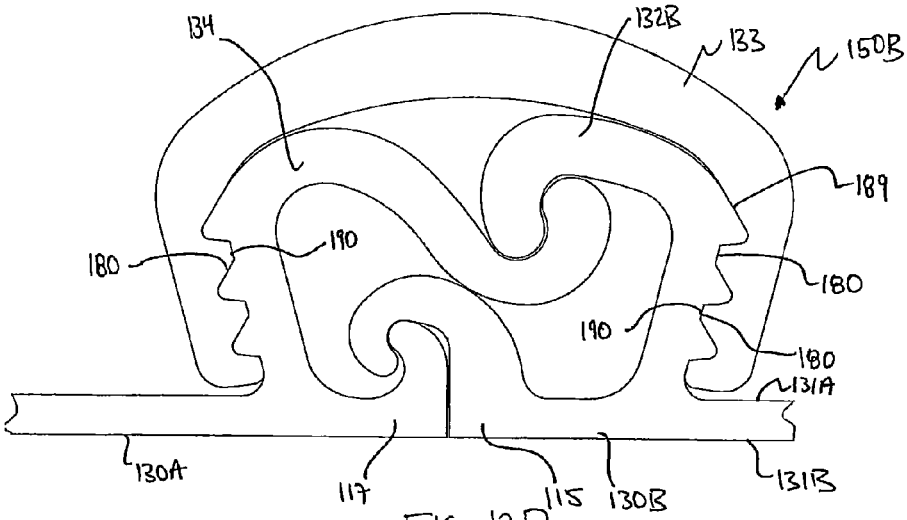
FIGS. 12A-12C (collectively, FIG. 12) respectively represent various elevation views of connector components and a clip for implementing edge-to-edge connections between adjacent panels of a form, according to other embodiments.
Figure 12B:
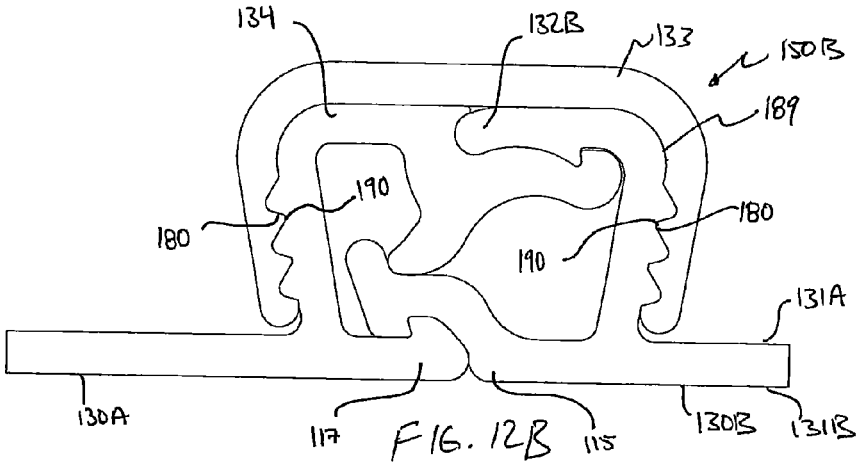
Figure 12C:
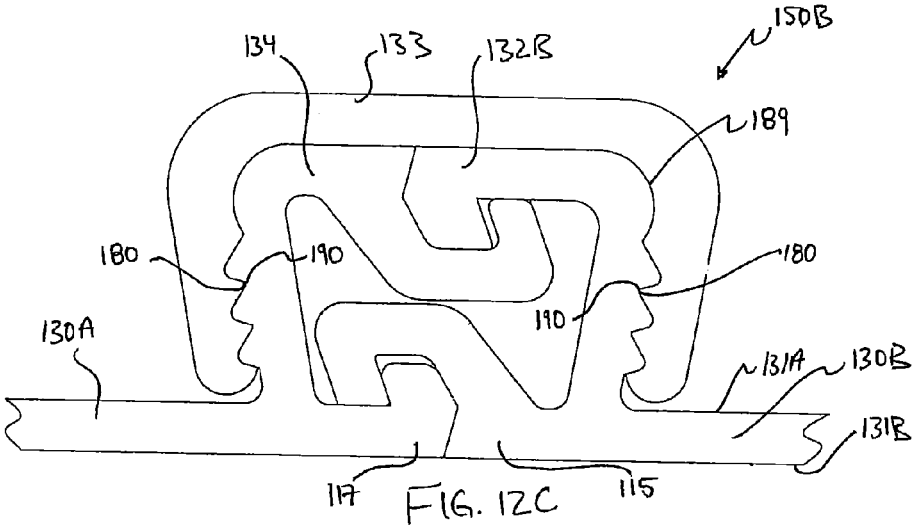

FIGS. 12A-12C show other embodiments of panels 130 which incorporate connector components that are coupled together with a clip 133. In these illustrated embodiments, adjacent panels 130A, 130B incorporate connector components 132, 134 which have portions that interleave or interlock before (or as) clip 133 is applied over connector components 132, 134 to form connection 150B between edge-adjacent panels 130A, 130B. Clip 133 may also have portions that interleave or interlock with corresponding portions on connector components 132, 134. For example, in the embodiments of FIGS. 12A-12C, the inside surface 189 of clip 133 is provided with a plurality of teeth 180 which are received within corresponding grooves 190 provided on connector components 132, 134. The interleaving portions (e.g. teeth 180 and grooves 190) provide resistance to unzipping and prevent or minimize leakage of liquids and, in some instances, gases, through connection 150B. Various engaging surfaces of connector components 132, 134 and/or clips 133 shown in FIGS. 12A-12C may be provided with sealing material similar to the sealing material described above for the other embodiments.

FIGS. 14A-14E represent various partial side elevation views of connector components 134, 232B and a clip 133 for implementing an edge-to-edge connection 250B between adjacent panels 130A, 230B of a form according to another embodiment. In the FIG. 14 embodiment, panel 130A and its connector component 134 and clip 133 are substantially similar to panel 130A and connector component 134 and clip 133 shown in FIG. 5 and described above and are referenced using the same reference numerals. Panel 230B and its connector component 232B are similar in many respects to panel 130B and connector component 132B shown in FIG. 5 and described above. Features of connector component 232B that are similar to connector component 132B are referenced using similar reference numerals to those of connector component 132B, except that the features of connector component 232B are preceded by the numeral '2' rather than the numeral '1'.

The principal difference between connector component 232B and connector component 132B is that contoured arm 256A is shorter than arm 156A and does not include distal end 156A' or protrusion 162. Connector component 232B comprises contoured arm 256B, thumb 263, receptacle 267, neck 257, concavity 259A and concavity 259C that are similar to arm 156B, thumb 163, receptacle 167, neck 157, concavity 159A and concavity 159C of connector component 132B.

Figure 14A:
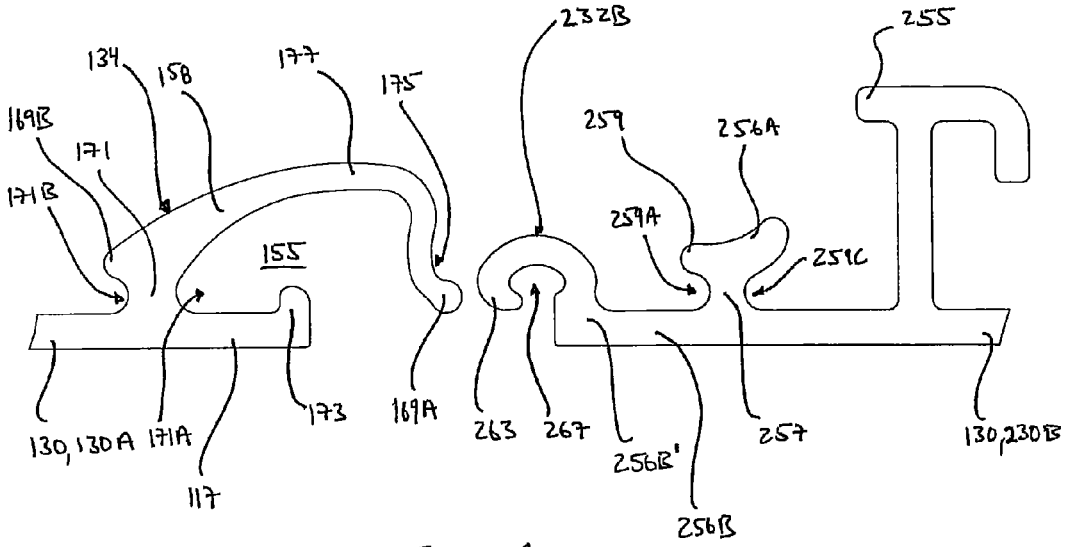
FIGS. 14A-14E (collectively, FIG. 14) represent various elevation views of connector components and a clip for implementing edge-to-edge connections between adjacent panels of a form, according to another embodiment.
Figure 14B:
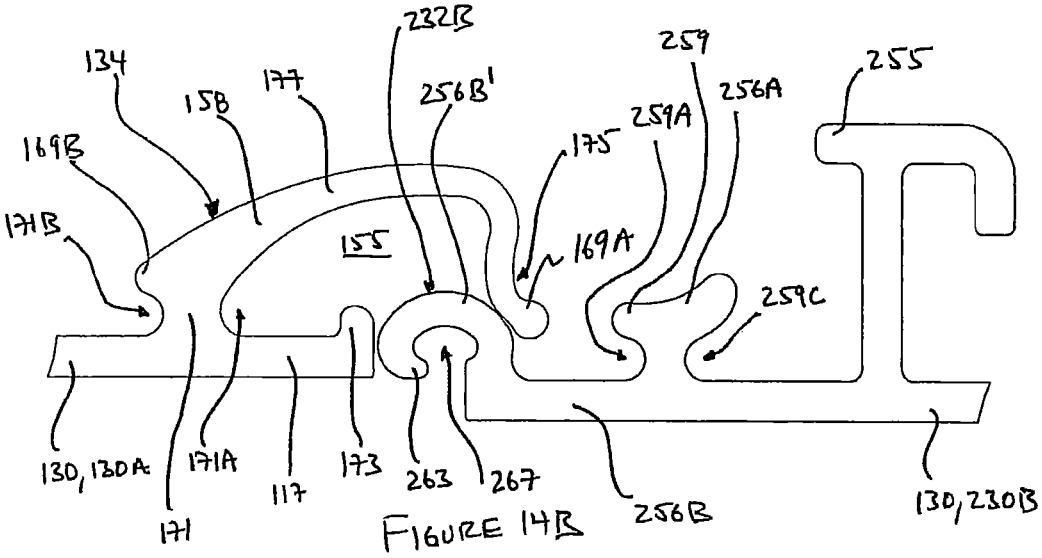
Figure 14C:
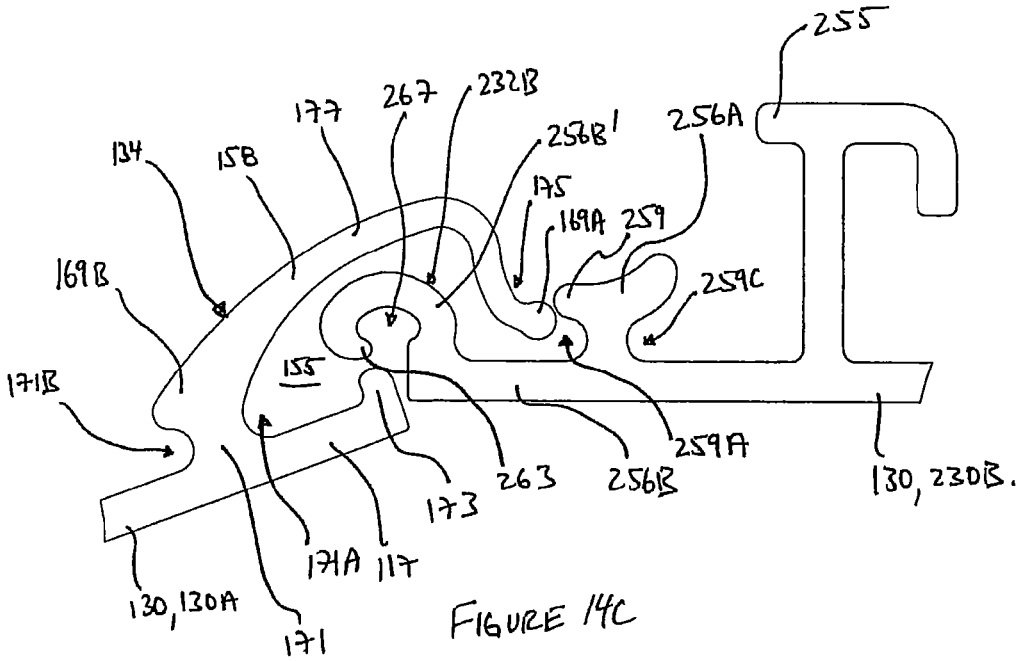
Figure 14D:
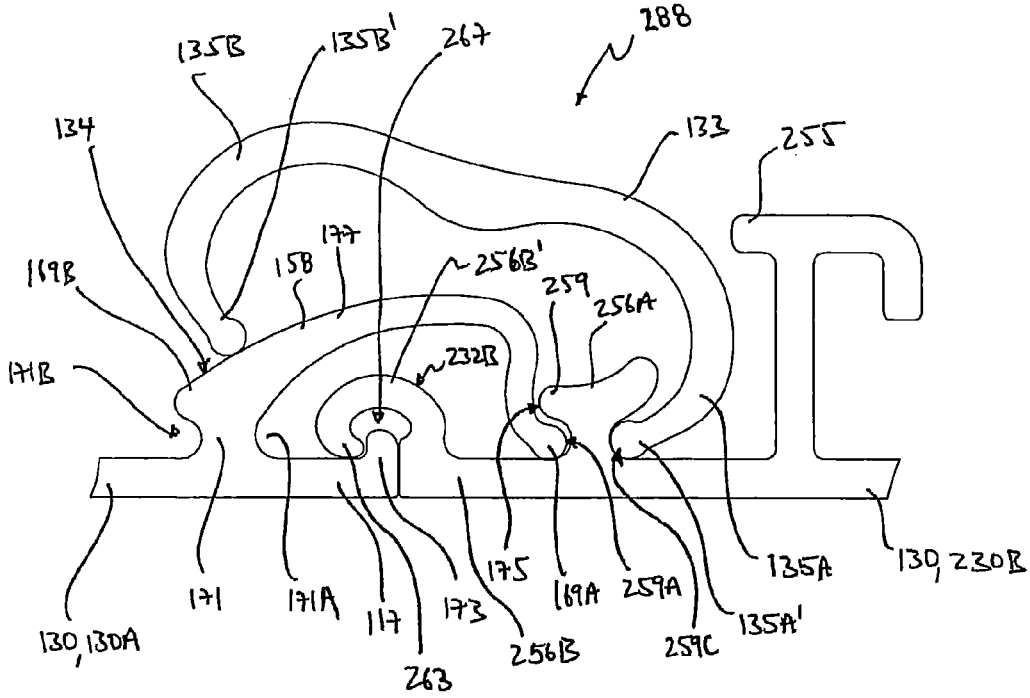

In operation, initially separated connector components 134, 232B are moved so as to engage them in the loose-fit configuration 288 of FIG. 14D. This may be accomplished by pushing distal portion 256B' of arm 256B into recess 155 of connector component 134 (FIG. 14B) together with the associated limited deformation of one or both of connector components 134, 232B. This technique may be similar to that of FIGS. 5B, 5C and 5E described above. Achieving loose-fit configuration 288 of FIG. 14D may additionally or alternatively involve relative pivotal (or quasi-pivotal) motion of connector component 134 relative to connector component 232B (FIG. 14C). This technique may be similar to that of FIG. 5C described above. As connector components 134, 232B approach loose-fit configuration 288, they may return to their undeformed states (i.e. any limited deformation associated with moving components 232B, 134 into loose-fit connection 288 may be relaxed so that connector components 232B, 134 return to their undeformed states once loose-fit connection 288 is achieved). Loose-fit connection 288 (FIG. 14D) may have any of the feature described above for loose-fit connection 188 (FIG. 5F) described above.

Figure 14E:
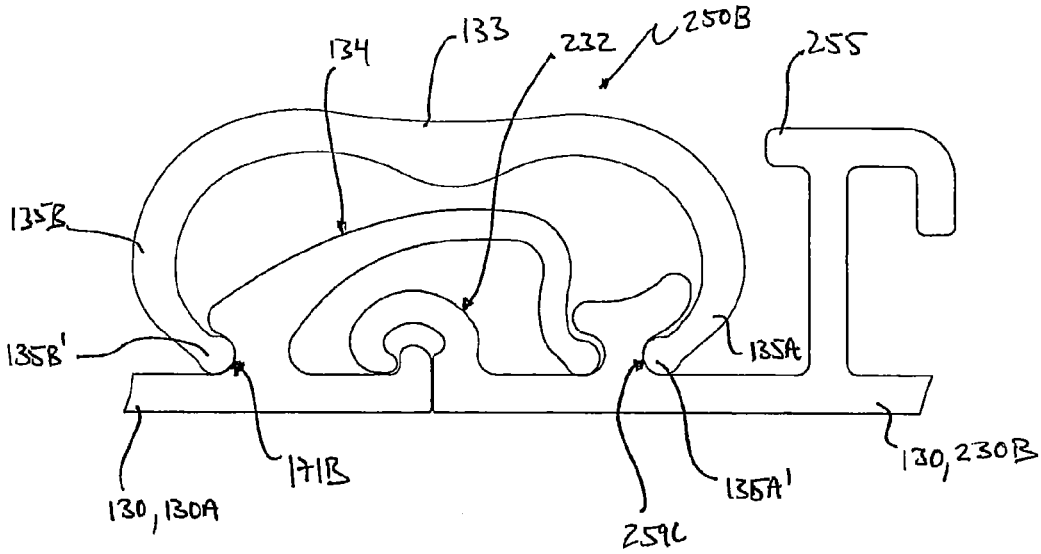

Once connector components 232B, 134 are in the loose-fit connection 288, clip 133 may be placed or seated loosely onto connector components 232B, 134 as shown in FIG. 14D. In the loosely seated configuration of FIG. 14D, arm 135A of clip 133 extends toward neck region 257 and distal end 135A' of arm 135A is initially positioned in concavity 259C of connector component 232B. In the illustrated view of FIG. 14D, distal end 135B' of arm 135B abuts secondary protrusion 169B of connector component 134B. Advantageously, with this configuration a protrusion 255 on an adjacent connector component of panel 232B may be used to retain clip 133 in its loosely seated configuration. The initial loosely seated configuration of FIG. 14D represents one particular embodiment, where clip 133 is initially oriented at an angle relative to its final locked configuration (FIG. 14E). In other embodiments, clip 133 may be initially loosely seated in an angular configuration similar to that of its final locked configuration (FIG. 14E).

Clip 133 may then be pushed, rotated or otherwise forced toward panels 130A, 230B causing arms 135A, 135B of clip 133 to deform such that restorative deformation forces associated with clip 133 tend to force distal end 135B' of arm 135B into concavity 171B and distal end 135A' of arm 135A into concavity 259C. The coupling of clip 133 to connector components 232B, 134 may be similar to that described above for clip 133 and connector components 132B, 134 and may be achieved by any of the above-described techniques. When clip 133 is coupled to connector components 232B, 134 in this manner, the result is a connection 250B (FIG. 14E).

As with connection 150B, connector components 132B, 134 and clip 133 described above, connection 250B, connector components 232B, 134 and clip 133 may be provided with a sealing material on some of their surfaces. Such sealing material may be relatively soft (e.g. elastomeric) when compared to the material from which the remainder of panels 130 is formed. In particular embodiments, such sealing material may be provided using a co-extrusion process. In other embodiments, such sealing material may be coated onto selected surfaces of connector components 232B, 134 and/or clip 133 after the formation thereof. Sealing material may help to make connection 150B more impermeable to liquids or gasses. By way of non-limiting example, such sealing material may be provided: in concavity 171B; on secondary protrusion 169A; in concavity 259A; on thumb 173; in secondary receptacle 267; on thumb 263; in concavity 171A; in concavity 259C; on projection 259; in concavity 175; and/or on interior surface 189 of clip 133.

Other features of connector components 232B, 134, clip 133 and connections 250B formed thereby may be similar to features described herein in connection with connector components 132B, 134, clip 133 and connections 150B formed thereby.

Figure 13A:
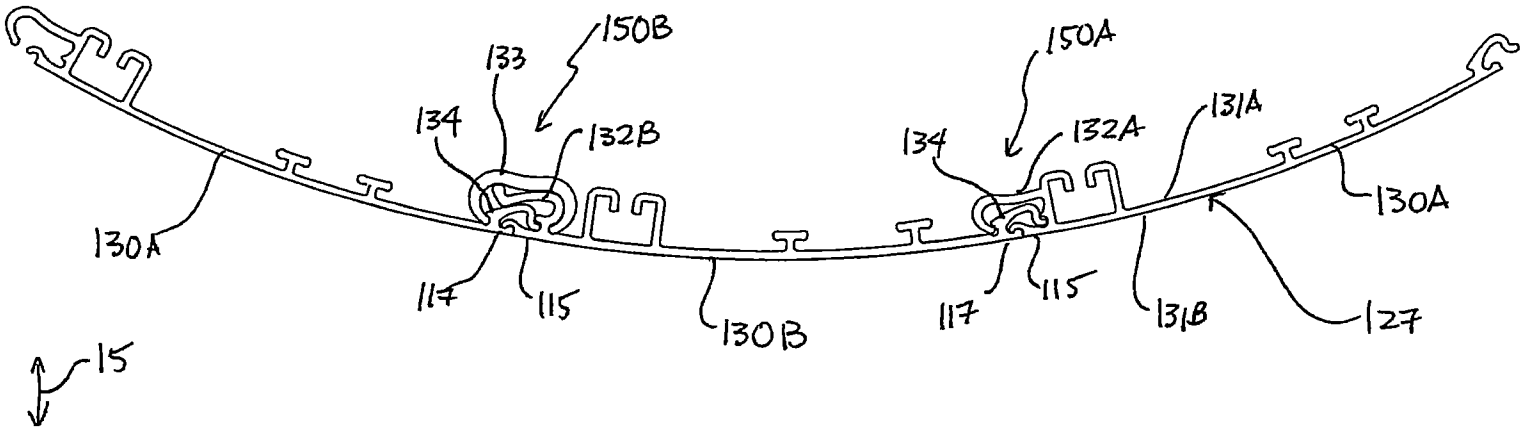
FIGS. 13A-13B (collectively, FIG. 13) respectively represent top plan views of wall segments of a modular stay-in-place form according to particular embodiments.

Any of the connections incorporating clips 133 which are described herein may be provided to connect edge-adjacent panels 130 which are not flat. In some embodiments, edge-adjacent panels 130 connected by connections incorporating clips 133 are curved in inward-outward direction 15. For example, FIG. 13A is a top plan view of a curved form segment 127 comprising a plurality of curved panels 130 that are connected in edge-adjacent fashion. Curved form segment 127 could be connected to other similarly curved form segments 127 to provide a form-work with a curved (e.g. round or cylindrical) cross-section, for example. To complete such a form-work structure (e.g. where all of the panels 130 have been connected together but for a last panel 130B), the last panel 130B (FIG. 13A) may be connected to an adjacent panel 130A by way of connection 150A and connected to the other adjacent panel 130A by way of a connection 150B incorporating clip 133.

To form connection 150B, connector component 134 at edge 117 of panel 130A is extended into receptacle 154 of connector component 132B at edge 115 of edge-adjacent panel 130B to provide a loose-fit connection 188 between connector components 132B, 134. The user completes the connection 150B by coupling a clip 133 to connector components 132B, 134 to retain connector components 132B, 134 in a locked configuration. Clip 133 may be coupled to connector components 132B, 134 by pushing or otherwise forcing clip 133 onto connector components 132B, 134 using one of the methods described above (e.g. using a slidable key 161 or other tool, or by manually applied force). Once the cylindrical form-work is completed, an interior of the form-work may be filled with concrete or similar curable construction material and used to fabricate a solid cylindrical column.

Such columns may be reinforced with traditional reinforcement bars or with other suitable support members. In some embodiments, the cylindrical form-work is constructed in place around an existing column or other existing structure and concrete is introduced into the interior of the form-work (and around the existing structure) to clad the existing structure in concrete. While FIG. 13A shows a single connection 150B incorporating a clip 133, this is not necessary. In general, any or all of the connection between edge-adjacent panels 130 may be provided by connections 150B incorporating clips 133.

Figure 13B:
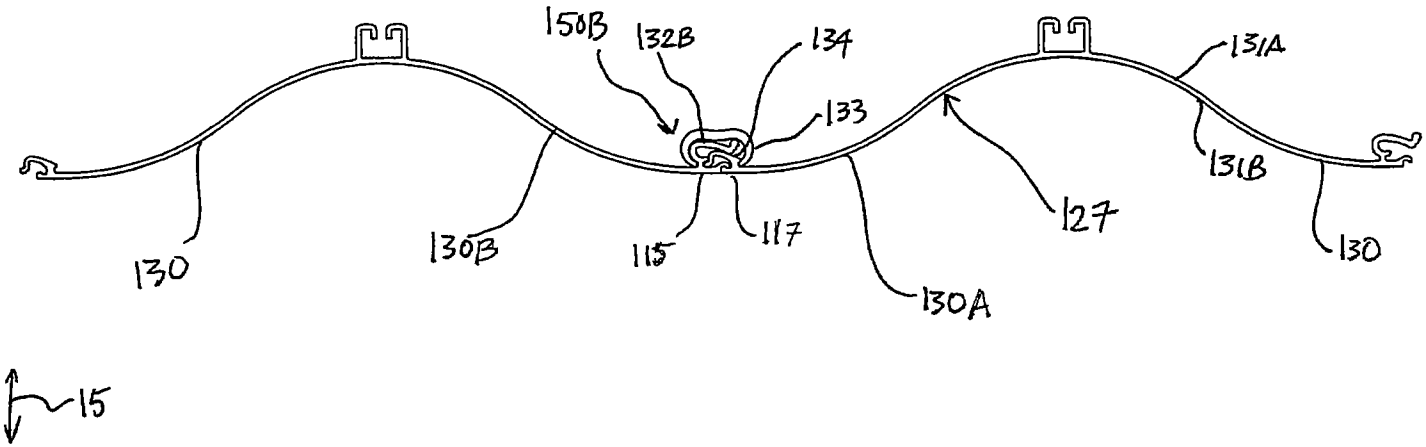

FIG. 13B is a top plan view of a form segment 127 according to another embodiment of the invention. Wall segment 127 comprises a pair of panels 130A, 130B (generally, panels 130) which are similar to the FIG. 3 panels 130A, 130B in many respects, except that the FIG. 13B panels 130A, 130B are curved to provide an undulating cross-section to form segment 127. Like the FIG. 3 panels, the FIG. 13B panel 130A incorporates a connector component 134 along its edge 117 and the FIG. 13B panel 130B incorporates a connector component 132B along its edge 115. Connector components 132B, 134 are connected to one another with a clip 133 to form a connection 150B.

In operation, panels 130 may be used to fabricate form-works (e.g. form-works 128A, 228A of FIGS. 3 and 4) by forming connections (e.g. connections 150A, 150B) between connector components of edge-adjacent panels 130 as discussed above. The FIG. 3 form-work 128A may serve as an interior surface of a structure formed by form-work 128A (e.g. an interior surface of a room or interior surface a building structure). Other panels 130 (not shown) may be connected in edge-adjacent relationship to create a rectangular form-work structure to define an exterior surface of the structure (such as shown in FIG. 4, which shows both interior and exterior surface 129, 131 of a structure). Panels 130 of exterior surface 131 have inward facing surfaces 131A which face toward interior surface 129 and incorporate connector components, and outward facing surfaces 131B which face away from interior surface 129. Likewise, panels 130 of interior surface 129 have inward facing surfaces 131A which face toward exterior surface 131 and incorporate connector components, and outward facing surfaces 131B which face away from exterior surface 131. Once panels 130 are connected to create both the interior and exterior surfaces of the form-work, other supporting form-work members (e.g. support members or tensioning members) may be added by slidably connecting connector components on the supporting form-work members to complementary connector components on panels 130. For example, support members 36A and/or tensioning members 40 may be connected between panels 130 on interior surface 129 and panels 130 on exterior surface 131 (see FIG. 4). If necessary or otherwise desired, transversely extending rebar and/or longitudinally extending rebar can then be inserted into the form-work. After the insertion of rebar, liquid concrete may be placed into the form-work to fill the space between the interior and exterior surfaces. When the liquid concrete cures, the result is a structure (e.g. a wall) that has its surfaces covered by the stay-in-place form-work (comprising components such as panels 130).

Any of the connections comprising clips 133 described herein may be used to provide connections between any edge-adjacent panels. Such edge-adjacent panels may be used together with other form-work components (e.g. support members, tensioning members and/or anchoring components) to provide form-works for fabricating structures from concrete or similar curable materials. Such form-works, which may include panels, support members, tensioning members and anchoring components, are described in more detail in the '951 PCT Application and in PCT application No. PCT/CA2008/000608 entitled METHODS AND APPARATUS FOR PROVIDING LININGS ON CONCRETE STRUCTURES filed 2 Apr. 2008, which is hereby incorporated by reference and hereinafter referred to as the '608 PCT Application. Any of the connections comprising clips 133 described herein may be used to provide connections between any edge-adjacent panels of the forms described in the '951 PCT Application and/or the '608 PCT Application.

In some embodiments, panels 130 and the supporting members (if present) may be connected to one another in any orientation and may then be placed in a desired orientation after such connection. In some embodiments, panels 130 and the supporting members (if present) may be assembled and connected to one another in place (i.e. in their desired orientation). In some embodiments, walls and other structures fabricated from panels 130 are oriented such that the longitudinal dimension (see arrow 19 of FIGS. 7A-7C) is vertically oriented. This is not necessary however. It will be appreciated that this description uses the directional terms longitudinal (arrow 19), transverse (arrow 17) and inward-outward (arrow 15) to facilitate explanation. However, it will be appreciated that walls and other structures fabricated using forms of the type described herein, in the '951 PCT Application and/or the '608 PCT Application can generally be made to extend in any orientation and, as such, the directional terms longitudinal, transverse and inward-outward used herein should be understood to include other directions which are not strictly limited to the conventional meanings of these terms. In general, longitudinal direction 19 may be oriented in any direction and inward-outward direction 15 and transverse direction 17 may be understood in their relationship to longitudinal direction 19.

Figure 15A:
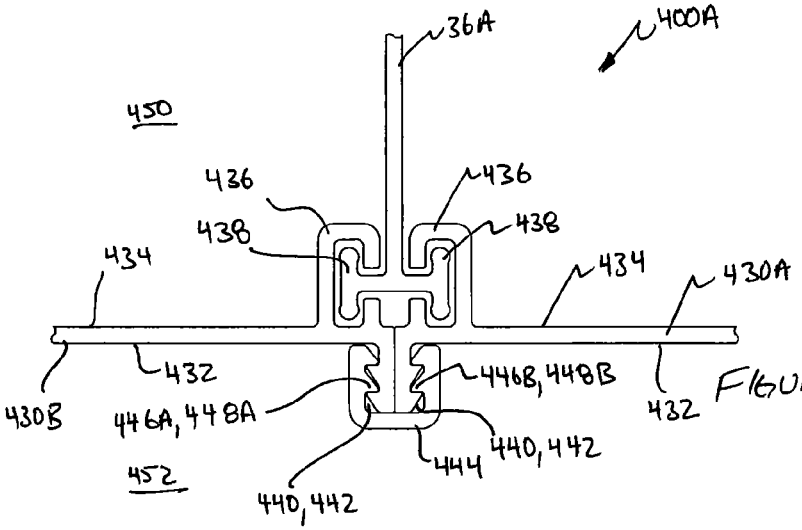
FIGS. 15A-15C (collectively, FIG. 156) show elevation view of connector components and clips for implementing edge-to-edge connections between edge-adjacent panels in a form according to other embodiments wherein the clips are located on an exterior of the panels.
Figure 15B:
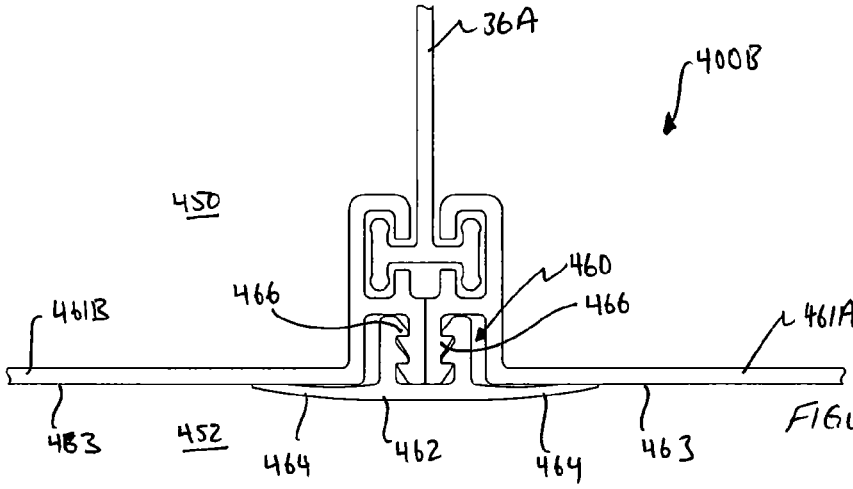
Figure 15C:
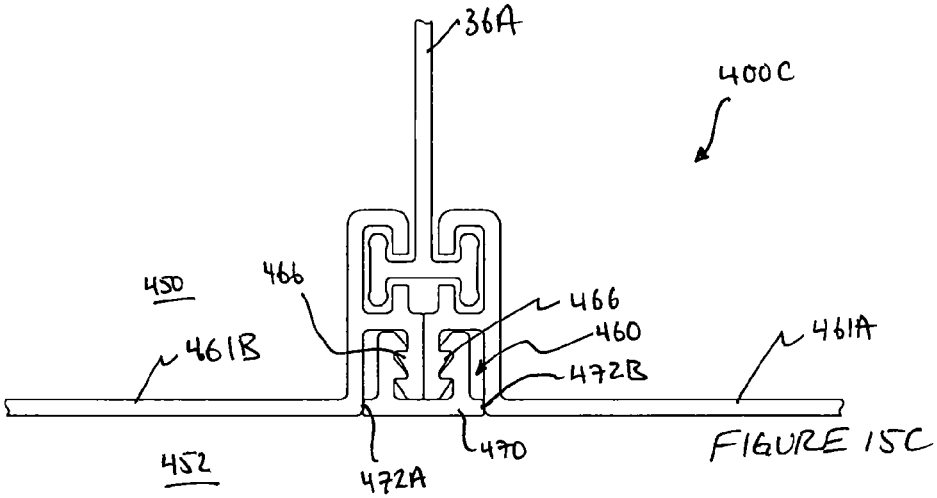

FIGS. 15A-15C show partial elevation views of panels and connections therebetween which may be used to fabricated form-works according to other embodiments. FIG. 15A shows a connection 400A between pair of edge-adjacent panels 430A, 430B (collectively, panels 430) that may provide a portion of a corresponding form-work. This form-work may be similar to the other form-works described herein and may be used to fabricate any structure from concrete or similar curable materials. Connection 400A differs from the other connections described above in that: (i) connection 400A incorporates a clip 444 which is connected to both of edge-adjacent panels 430A, 430B to help make connection 400A, but clip 444 is located on an outside 452 of panels 430; and (ii) connection 400A incorporates a support panel 36 located on an inside 450 of panels 430 which is connected to both of edge-adjacent panels 430A, 430B to help make connection 400A.

Other than for being located on outside 452 of panels 430, clip 444 and its connection to edge-adjacent panels 430 is similar in many respects to clip 133' of FIGS. 11A-11C and its connection to panels 130A, 130B of FIGS. 11A, 11B. Clip 444 comprises arms 446A, 446B that define a receptacle (not specifically enumerated). Panels 430 comprise exterior surfaces 432 and interior surfaces 434. Panels 430 incorporate edge components 440 (similar to edge components 132', 134' of FIGS. 11A-11C) which are shaped to provide raised edge portions that abut against one another and which are inserted into the receptacle of clip 444 to form connection 400A. Clip 444 (e.g. arms 446A, 446B) may deform as clip 444 is forced onto edge components 440. Restorative forces associated with the deformation of clip 444 tend to force the abutting edge components 440 of edge-adjacent panels 430A, 430B against one another and to cause clip 444 to retain edge components 440 in the locked configuration shown in FIG. 15A. In some embodiments, clip 444 may be pushed onto edge components 440 or otherwise forced into the FIG. 15A locked configuration with the assistance of a tool (e.g. similar to slidable key 161 described above), pliers, hammer, block of wood or the like.

As shown in FIG. 15A, one of the surfaces of each of edge components 440 comprises optional protrusions 442 (and/or recesses) which interleave with corresponding optional protrusions 448A, 448B (and/or recesses) on arms 446A, 446B of clip 444. These interleaving protrusions 442, 448A, 448B may provide: resistance to unzipping and prevention or minimization of leakage of liquids or gasses through connection 400A.

Figure 1:
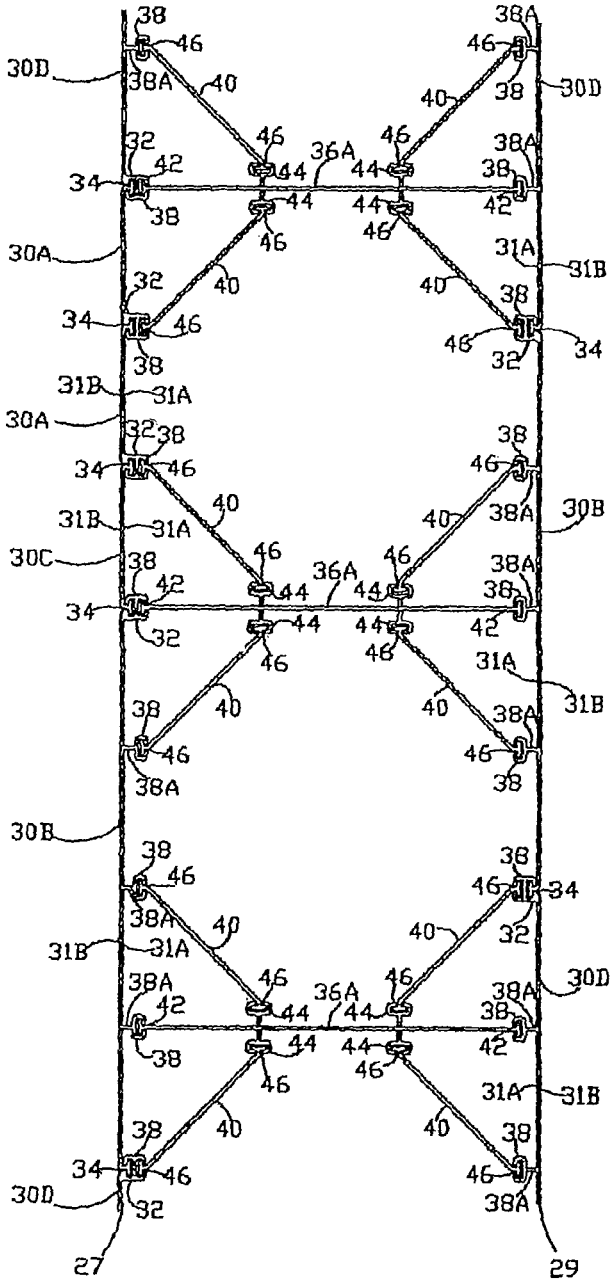
PRIOR ART FIGURE 1
FIG. 1 is a top plan view of a prior art modular stay-in-place form.
Figure 2:
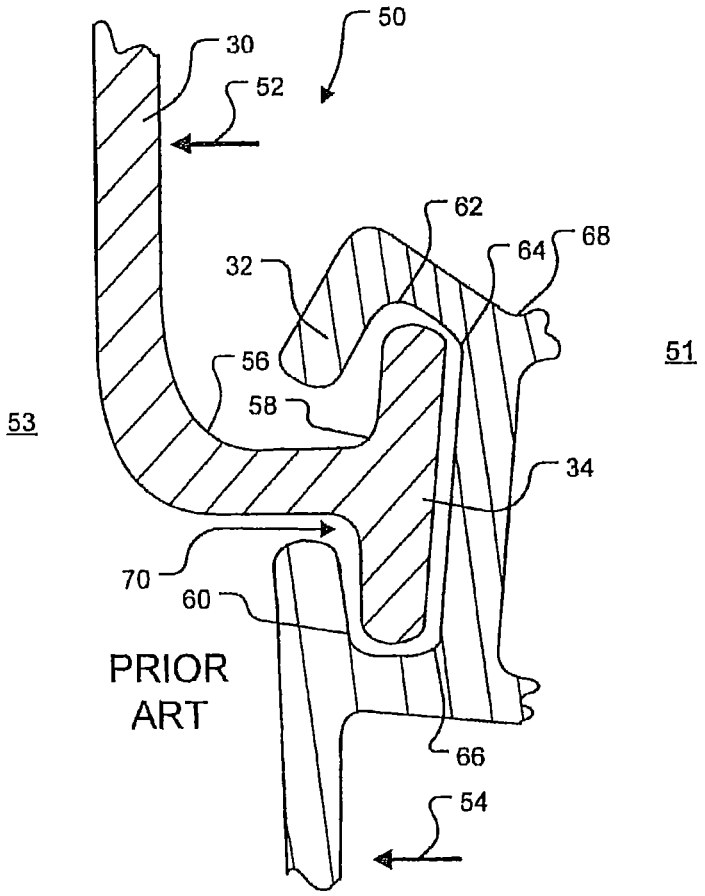
FIG. 2 is a magnified partial plan view of the FIG. 1 form, showing the unzipping of a connection between wall panels.

Each of panels 430A, 430B of connection 400A also includes a connector component 436 which engages with a corresponding connector component 438 of a support member 36A on inside 450 of panels 430. In this manner, connection 400A is reinforced by the connection of each edge-adjacent panel 430A, 430B to a single support member 36A. Although not shown in FIG. 15A, support member 36A may extend across the form-work provided by panels 430 (e.g. to corresponding panels on the other side of the form-work) in a manner similar to support members 36A shown in FIG. 1 and/or FIG. 4. In the illustrated embodiment, connector components 436 of panels 430 and connector components 438 of support panel 36A are slidably engaging connector components wherein male T-shaped connector components 438 fit into female C-shaped connector components 436 and slide relative to one another in longitudinal directions (i.e. into and out of the page in the illustrated view of FIG. 15A). In other embodiments, the connections between edge-adjacent panels 430A, 430B could be provided by other types of connector components which connect to one another using different techniques (e.g. deformation-based connections, pivotal connections or the like). In other embodiments, the connections between edge-adjacent panels 430A, 430B could be provided by slidable connector components having different shapes or different male/female configuration.

In some embodiments, a sealing material (not shown) may be provided on some surfaces of connector components 436, 438, edge components 440 and/or clip 444. Such sealing material may be relatively soft (e.g. elastomeric) when compared to the material from which the remainder of panels 430 is formed. Such sealing materials may be provided using a co-extrusion process or may be coated onto selected surfaces of connector components 436, 438, edge components 440 and/or clip 444 after the formation thereof. Such sealing materials may help to make connection 400A impermeable to liquids or gasses.

In other respects, connection 400A may be similar to and incorporate features similar to the other connections described herein.

FIG. 15B shows a connection 400B between pair of edge-adjacent panels 461A, 461B (collectively, panels 461) that may provide a portion of a corresponding form-work. Connection 400B is similar in many respects to connection 400A and includes a clip 462 that fits over abutting edge components 466 of edge-adjacent panels 461 and a support member 36A that connects to each of edge-adjacent panels 461. Connection 400B differs from connection 400A in that: (i) panels 461 are shaped to provide a recess 460 in which their edge components 466 are located; and clip 462 includes a flange portion 464 which covers recess 460 and abuts against exterior surfaces 463 of edge-adjacent panels 461. Sealing material may optionally be provided in recess 460 and/or between flange portion 464 of clip 462 and exterior surfaces 463 of edge-adjacent panels 461. In other respects, connection 400B may be similar to connection 400A.

FIG. 15C shows a connection 400C between pair of edge-adjacent panels 461A, 461B (collectively, panels 461) that may provide a portion of a corresponding form-work. Connection 400C is similar in many respects to connection 400B and includes a clip 470 that fits over abutting edge components 466 of edge-adjacent panels 461 and a support member 36A that connects to each of edge-adjacent panels 461. Connection 400C differs from connection 400B in that clip 470 plugs into recess 460 rather than having a flange that extends over the exterior surfaces 463 of edge-adjacent panels 461. More specifically, clip 470 comprises edges 472A, 472B that abut against recess forming portions of panels 461A, 461B to permit clip 470 to form a friction-fit plug in recess 460. In other respects, connection 400C may be similar to connection 400B.

Other than for the differences described above in relation to their connections 400A, 400B, 400C, panels 430, 461, support members 36A and clips 444, 464, 470 of FIG. 15 may be used to fabricate form-works (e.g. form-works similar to form-works 128A, 228A of FIGS. 3 and 4) and to fabricate corresponding structures in a manner similar to any of the other panels and connections described herein.

It is not necessary that support member 36A be connected to both panels 430A, 430B (of connection 400A) or to both panels 461A, 461B (of connection 400B). In other embodiments, a pair of connector components 436 may be provided on a single panel 430A, 461A and a support member 36A could be connected (via its connector components 438) to a single panel 430A, 461A. In some embodiments, the connection of support member 36A to a single panel to 430A, 461A is in a location adjacent to connections 400A, 400B, 400C, such that support member 36A can support the corresponding connection.

As will be apparent to those skilled in the art in the light of the foregoing disclosure, many alterations and modifications are possible in the practice of this invention without departing from the spirit or scope thereof. For example:

- In some embodiments, it may be desirable to provide walls which incorporate insulation. Insulation may be provided in the form of rigid foam insulation. Non-limiting examples of suitable materials for rigid foam insulation include: expanded poly-styrene, poly-urethane, poly-isocyanurate or any other suitable moisture resistant material. By way of non-limiting example, insulation layers may be provided in any of the forms described herein. Such insulation layers may extend in the longitudinal direction and in a transverse direction (i.e. between the interior and exterior surfaces of a form-work). Such insulation layers may be located centrally within the wall or at one side of the wall.
- In the embodiments described herein, the structural material used to fabricate the wall segments is concrete. This is not necessary. In some applications, it may be desirable to use other structural materials which may be initially be introduced placed into forms and may subsequently solidify or cure.
- In the embodiments describes herein, the outward facing surfaces 131B of some panels (e.g. panels 130) are substantially flat. In other embodiments, panels 130 may be provided with corrugations in the inward-outward direction indicated by double-headed arrow 15 in FIG. 5A. Such corrugations may extend longitudinally (direction 19) and/or transversely (direction 17). Such corrugations may help to prevent pillowing of panels 130 under the weight of liquid concrete.

In the embodiments described herein, various features of the panels 130 (e.g. connector components 132A, 132B and 134) are substantially co-extensive with panels 130 in the longitudinal dimension 19. This is not necessary. In some embodiments, such features may be located at various locations on the longitudinal dimension 19 of panels 130 and may be absent at other locations on the longitudinal dimension 19 of panels 130. Forms incorporating any of the other panels described herein may comprise similarly dimensioned supporting form-work members and/or clips 133 for engaging with connector components 132B, 134.

Clips 133 may also be substantially co-extensive with panels 130 in the longitudinal dimension 19, but this is not necessary. In some embodiments, clips 133 may be dimensioned such that they may be located at various locations on the longitudinal dimension 19 of panels 130 and may be absent at other locations on the longitudinal dimension 19 of panels 130. The clips of other embodiments descried herein may be similarly dimensioned.

In some embodiments, sound-proofing materials may be layered into the forms described above or may be connected to attachment units.

In some embodiments, the forms described herein may be used to fabricate walls, ceilings or floors of buildings or similar structures. In general, the forms described above are not limited to building structures and may be used to construct any suitable structures formed from concrete or similar materials. Non-limiting examples of such structures include transportation structures (e.g. bridge supports and freeway supports), beams, foundations, sidewalks, pipes, tanks, beams and the like.

Structures (e.g. walls) fabricated according to the invention may have curvature. Where it is desired to provide a structure with a certain radius of curvature, panels on the inside of the curve may be provided with a shorter length than corresponding panels on the outside of the curve. This length difference will accommodate for the differences in the radii of curvature between the inside and outside of the curve. It will be appreciated that this length difference will depend on the thickness of the structure.

In addition or in the alternative to the co-extruded coating materials and/or surface texturing described above, materials (e.g. sealants and the like) may be provided at various interfaces between connector components 132B, 134 to improve the impermeability of the resulting connections to liquids and/or gasses. By way of non-limiting example, a bead or coating layer of sealing material may be provided: on distal end 156A' of arm 156A; on protrusion 162; in concavity 171B; on secondary protrusion 169A; in concavity 159A; in concavity 159C; on thumb 173; in secondary receptacle 167; on thumb 163; in concavity 171A; in concavity 159C; on projection 159; in concavity 175; on inside surface 189 of clip 133; and/or on protrusion 162.

In some of the embodiments described herein, connector components 132B, 134 initially engage one another to provide a loose-fit connection therebetween and then clip 133 is coupled to connector components 132B, 134 to complete the connection 150B. The initial loose fit connection is not necessary. In general, edge-adjacent panels may comprise edge components which provide virtually no connection to one another (in the absence of clip 133) or may comprise connector components which form a substantially complete connection to one another independent of clip 133.

The loose fit connections between connector components 132B, 134 need not be exactly as shown in loose-fit connection 188 of FIG. 5F. In some embodiments, the loose fit connection between connector components 132B, 134 may be different, but the coupling of clip 133 to connector components 132B, 134 applies force to connector components 132B, 134 such that they achieve the final locked configuration of FIG. 5I.

Portions of connector components 132B, 134 may be coated with or may otherwise incorporate antibacterial, antiviral and/or antifungal agents. By way of non-limiting example, Microban™ manufactured by Microban International, Ltd. of New York, N.Y. may be coated onto and/or incorporated into connector components 132B, 134 during manufacture thereof.

FIGS. 15A-15C show embodiments of panel-to-panel connections wherein the clip is located on the outside of the formwork, wherein the clip is located in a recess, wherein the clip comprises plug to fill the recess, wherein the clip comprises a flange that covers the recess and wherein a support member is connected to each of the edge-adjacent panels to reinforce the connection. Any of the other embodiments of the invention may be modified to provide these features.

Many embodiments and variations are described above. Those skilled in the art will appreciate that various aspects of any of the above-described embodiments may be incorporated into any of the other ones of the above-described embodiments by suitable modification.

Accordingly, the invention should be construed in accordance with the following claims or claims hereafter introduced.

What is claimed is:

1. A stay-in-place form-work for casting a structure from concrete or other curable construction materials, the stay-in-place form-work comprising:

a plurality of elongate panels connected in edge-to-edge relationship to define at least a portion of a perimeter of the form-work, the plurality of panels comprising a first panel connected via an edge-to-edge connection to a second panel, the first panel comprising a first edge component and the second panel comprising a second edge component, the first and second edge components engaging one another; and a clip comprising first and second arms, the clip engaging the first and second edge components in a locked configuration wherein the clip is resiliently deformed such that the clip exerts restorative deformation forces against the first and second edge components to thereby maintain the edge-to-edge connection in the locked configuration;

wherein the first edge component comprises a projection, the second edge component comprises a receptacle and the engagement between the first and second edge components comprises an extension of the projection into the receptacle.

2. A form-work according to claim 1 wherein the engagement between the first and second edge components comprises a loose-fit engagement wherein extracting the projection from the receptacle requires deformation of at least one of the first and second edge components.

3. A form-work according to claim 2 wherein a force required to deform the at least one of the first and second edge components and to extract the projection from the receptacle is greater than the force of gravity on either of the first and second panels.

4. A form-work according to claim 1 wherein the extension of the projection into the receptacle comprises deformation of at least one of first and second edge components.

5. A form-work according to claim 1 wherein at least a portion of each of the first and second arms of the clip is coated with a sealant material.

6. A form-work according to claim 5 wherein the sealant material is co-extruded with the clip.

7. A form-work according to claim 1 wherein at least a portion of at least one of the projection and the receptacle is coated with a sealant material.

8. A form-work according to claim 7 wherein the sealant material is co-extruded with a corresponding panel of the plurality of panels.

9. A form-work according to claim 1 wherein at least a portion of the first and second edge components are coated with a sealant material.

10. A form-work according to claim 9 wherein the sealant material is co-extruded with a corresponding panel of said plurality of panels.

11. A form-work according to claim 1 wherein the first and second arms of the clip define a receptacle and the first and second edge components extend at least partially into the receptacle of the clip.

12. A form-work according to claim 1 wherein the first arm of the clip exerts restorative deformation force against the first edge component and the second arm of the clip exerts restorative deformation force against the second edge component.

13. A form-work according to claim 12 wherein the first arm comprises a first distal portion which extends into a corresponding first concavity in the first edge component and the second arm comprises a second distal portion which extends into a corresponding second concavity in the second edge component.

14. A form-work according to claim 13 wherein at least a portion of at least one of the first distal portion and the first concavity is coated with a sealant material and at least a portion of at least one of the second distal portion and the second concavity is coated with a sealant material.

15. A form-work according to claim 1 wherein the clip is located on an exterior of the form-work opposite a region in which the structure is cast.

16. A form-work according to claim 1 wherein the clip is located on an interior of the form-work in a region in which the structure is cast.

17. A form-work according to claim 1 wherein the panels are shaped to define a recess in which the first and second edge components are located when the first and second edge components are engaged.

18. A form-work according to claim 17 where the clip comprises a flange which covers an entrance to the recess.

19. A form-work according to claim 17 wherein the clip is shaped to fit into the recess.

20. A stay-in-place form-work for casting a structure from concrete or other curable construction materials, the stay-in-place form-work comprising:

a plurality of elongate panels connected in edge-to-edge relationship to define at least a portion of a perimeter of the form-work, the plurality of panels comprising a first panel connected via an edge-to-edge connection to a second panel, the first panel comprising a first edge component and the second panel comprising a second edge component, the first and second edge components engaging one another; and a clip comprising first and second arms, the clip engaging the first and second edge components in a locked configuration wherein the clip is resiliently deformed such that the clip exerts restorative deformation forces against the first and second edge components to thereby maintain the edge-to-edge connection in the locked configuration;

wherein the first arm of the clip exerts restorative deformation force against the first edge component and the second arm of the clip exerts restorative deformation force against the second edge component;

wherein the first arm comprises a first distal portion which extends into a corresponding first concavity in the first edge component and the second arm comprises a second distal portion which extends into a corresponding second concavity in the second edge component; wherein the locked configuration engagement between the clip and the first and second edge components is a snap-together engagement wherein removing either of the first distal portion of the first arm from the first concavity or the second distal portion of the second arm from the second concavity requires deformation of the clip in a direction opposed to the restorative deformation force.

21. A form-work according to claim 20 wherein the first and second arms of the clip define a receptacle and the first and second edge components extend at least partially into the receptacle of the clip.

22. A form-work according to claim 20 wherein the first edge component comprises a projection, the second edge component comprises a receptacle and the engagement between the first and second edge components comprises an extension of the projection into the receptacle.

23. A form-work according to claim 20 wherein at least a portion of at least one of the first distal portion and the first concavity is coated with a sealant material and at least a portion of at least one of the second distal portion and the second concavity is coated with a sealant material.

24. A form-work according to claim 20 wherein at least a portion of each of the first and second arms of the clip is coated with a sealant material.

25. A form-work according to claim 20 wherein at least a portion of the first and second edge components are coated with a sealant material.

26. A form-work according to claim 20 wherein the clip is located on an exterior of the form-work opposite a region in which the structure is cast.

27. A form-work according to claim 20 wherein the clip is located on an interior of the form-work in a region in which the structure is cast.

28. A form-work according to claim 20 wherein the panels are shaped to define a recess in which the first and second edge components are located when the first and second edge components are engaged.

29. A form-work according to claim 28 where the clip comprises a flange which covers an entrance to the recess.

30. A form-work according to claim 28 wherein the clip is shaped to fit into the recess.

* * * * *